US005619225A

United States Patent [19]

Hashimoto

[11] Patent Number: 5,619,225

[45] Date of Patent: Apr. 8, 1997

[54] LIQUID CRYSTAL DISPLAY APPARATUS AND METHOD OF DRIVING THE SAME

[75] Inventor: Seiji Hashimoto, Yokohama, Japan

[73] Assignee: Canon Kabushiki Kaisha, Tokyo, Japan

[21] Appl. No.: 666,919

[22] Filed: Jun. 19, 1996

Related U.S. Application Data

[63] Continuation of Ser. No. 281,005, Jul. 27, 1994, abandoned.

[30] Foreign Application Priority Data

| | | | |
|---|---|---|---|
| Jul. 30, 1993 | [JP] | Japan | 5-190092 |
| Feb. 7, 1994 | [JP] | Japan | 6-033217 |
| May 12, 1994 | [JP] | Japan | 6-098677 |
| Jul. 1, 1994 | [JP] | Japan | 6-171555 |

[51] Int. Cl.[6] ..... G09G 3/36

[52] U.S. Cl. ..... 345/98; 345/88; 345/99

[58] Field of Search ..... 345/87, 88, 98, 345/99, 100; 348/790, 791, 792, 793; 359/55, 57, 54, 58

[56] References Cited

U.S. PATENT DOCUMENTS

| | | | |
|---|---|---|---|
| 4,745,406 | 5/1988 | Hayashi et al. | 345/88 |
| 4,745,485 | 5/1988 | Iwasaki | 345/88 |
| 4,825,203 | 4/1989 | Takeda et al. | 345/88 |
| 4,908,609 | 3/1990 | Stroomer | 345/88 |
| 5,172,249 | 12/1992 | Hashimoto | 358/482 |
| 5,311,205 | 5/1994 | Hamada et al. | 345/88 |
| 5,369,417 | 11/1994 | Tanaka | 345/100 |
| 5,412,397 | 5/1995 | Kanatani et al. | 345/100 |

FOREIGN PATENT DOCUMENTS

| | | |
|---|---|---|
| 0320562 | 6/1989 | European Pat. Off. . |
| 0461928 | 12/1991 | European Pat. Off. . |

OTHER PUBLICATIONS

Proceedings Of The SID, vol. 30, No. 3, 1989, New York, USA, pp. 259–262, XP000115848 Kohda S Et Al: "A Defect–Tolerant Active–Matrix Circuit And Its Application To A High–Resolution Color LCD" * figure 4; section IV *.

*Primary Examiner*—Regina D. Liang

*Attorney, Agent, or Firm*—Fitzpatrick, Cella, Harper & Scinto

[57] ABSTRACT

A liquid-crystal display apparatus which improves horizontal and vertical resolutions and is capable of displaying a high-quality image free from flicker is provided. Pixels of each color are arranged in a delta form, color selected from the pixels of each color is connected to a column data line, at least one memory circuit is disposed in correspondence with the selected color, and image information is supplied to each pixel in such a way that the image information is distributed to the upper and lower portions of the column data line.

8 Claims, 22 Drawing Sheets

15
R G B
G B R
B R G 10
11
12
13
14
R
G
B
G
V • SR
20
H • SR
30
SIGNAL PROCESSING CIRCUIT
40
CONTROL CIRCUIT
50

1H
FIG.7(a) φg2
(PRIOR ART)
FIG.7(b) φg3
(PRIOR ART)
FIG.7(c) φg4
(PRIOR ART)
FIG.7(d) φg5
(PRIOR ART)
FIG.7(e) h1
(PRIOR ART)
FIG.7(f) h2
(PRIOR ART)
FIG.7(g) h3
(PRIOR ART)
FIG.7(h) h4
(PRIOR ART)

FIG.9(a) (PRIOR ART) $g_2$

FIG.9(b) $g_3$ (PRIOR ART)

FIG.9(c) $g_4$ (PRIOR ART)

FIG.12(a) R(G,B)

FIG.12(b) $\phi H_{1n}$

FIG.12(c) $\phi H_{2n}$

FIG.12(d) $\phi c$

FIG.12(e) $\phi T1$

FIG.12(f) $\phi T2$

FIG.12(g) $\phi Go$

FIG.12(h) $\phi Ge$

FIG.12(i) $\phi G$ 1H
1H

R(G,B)
H·BAK
H·BAK

H1n
H11 H12 H13 H14
B1
(D1)
R1
(D2)
G1
(D3)

H2n
H21 H22 H23 H24
B2
(D2)
R2
(D3)
G2
(D4)

φc
P1 P4

φT1
P3

φT2
P6

φGo
P2

φGe
L H
P5

φG
L 1H
1H
φC
φH2
φH1
φT
φg1
φg2
φg3
φg4
(MEMORY)
(direct)
h22
h21
h23
h11
h12
h13
T1
T2
T3
T4
T3'
(MEMORY)
(direct)
φC
φT
φg1
φg2
(MEMORY)
(Sig)
. . .

LIQUID CRYSTAL DISPLAY APPARATUS AND METHOD OF DRIVING THE SAME

This application is a continuation of application Ser. No. 08/281,005 filed Jul. 27, 1994, now abandoned.

BACKGROUND OF THE INVENTION

1. Field of the Invention

The present invention relates to a liquid-crystal display apparatus and a method of driving the same liquid-crystal display apparatus. More particularly, the present invention relates to a liquid-crystal display apparatus which is capable of displaying a high-quality image and a method of driving the same liquid-crystal display apparatus.

2. Description of the Related Art

In recent years, liquid-crystal display apparatuses which can be formed into thin apparatuses as display elements and which use liquid-crystal display elements which consume a small amount of power have come to be increasingly practical.

An explanation will be given below of a color liquid-crystal display apparatus and a method of driving the same liquid-crystal display apparatus with reference to the drawings.

FIG. 1(*a*) is a schematic block diagram illustrating an example of a color liquid-crystal display apparatus, and FIG. 1(*b*) is a schematic view illustrating the color arrangement of a filter thereof. In FIGS. 1(*a*) and 1(*b*), reference numeral 10 denotes a liquid-crystal display element; reference numeral 11 denotes a switching transistor, such as a thin film transistor (TFT), in which amorphous silicon or polysilicon is used in a semiconductor layer; reference numeral 12 denotes a pixel electrode; reference numeral 13 denotes a row control line; reference numeral 14 denotes a column control line; reference numeral 20 denotes a vertical scanning circuit (V·SR); reference numeral 30 denotes a horizontal scanning circuit (H·SR); reference numeral 40 denotes a signal processing circuit; and reference numeral 50 denotes a control circuit. In a filter 15 shown in FIG. 1(*b*), R designates red, G designates green, and B designates blue. This filter 15 corresponds to the pixel electrode 12 in this order of color arrangement.

As shown in FIG. 1(*a*), the liquid-crystal display element 10 has switching transistors 11 for each pixel. The switching transistors have a great number of pixels such that the source (or drain) is connected to the column data line 14, the drain (or source) is connected to the pixel electrode 12, and the gate is connected to row control line 13. The pixel electrodes 12 are arranged in horizontal and vertical lines, and in correspondence with this arrangement, the colors in the filter 15 are arranged in horizontal and vertical lines.

The row control lines 13 are each connected to the vertical scanning circuit 20, and the column control lines 14 are each connected to the horizontal scanning circuit 30. A signal from the control circuit 50 is input to each of the vertical scanning circuit 20 and the horizontal scanning circuit 30. Further, a signal having image information is input from the signal processing circuit 40 to the horizontal scanning circuit 30.

Pulses are in turn applied from the vertical scanning circuit 20 to the row control lines 13 at every horizontal scanning period so that the switching on/off of the switching transistors 11 for the respective adjacent pixels is controlled. The color signals R, G and B from the signal processing circuit 40 are in turn selected by the horizontal scanning circuit 30 and supplied to the column control line 14. The control circuit 50 drives and controls the vertical scanning and horizontal scanning of the display apparatus, and the signal processing circuit in accordance with the operation of the system.

FIG. 2 shows a method of inputting color signals in the case of the color filter arrangement shown in FIGS. 1(*a*) and 1(*b*). In the color filter shown in FIGs. 1(*a*) and 1(*b*), it is necessary to input signals in the order of R, G and B for one pixel line when seen from the column data line 14. Therefore, the color signals of signal lines 31, 32 and 33 are switched by a color switching circuit 41 for each line.

Therefore, the signals having color information for each of R, G and B from the signal processing circuit 40 are distributed into signals having color information corresponding to each filter 15, and then input to the signal lines 31, 32 and 33. A switching element 16 is turned on/off by the horizontal scanning circuit 30, thereby supplying a signal having color information corresponding to the pixel connected to the column data line 14.

However, in the case of FIGS. 1(*a*) and 1(*b*), since the same color filters are arranged obliquely, the image is obliquely seen as a color and a line, and the image quality is deteriorated. Also, since a color switching circuit is necessary, it has been considered to prevent the image quality from being deteriorated and to construct the apparatus by using a small number of circuits.

An example of the above will be explained below with reference to FIG. 3. In the example shown in FIG. 3, to solve the problem of the above-described image deterioration, the odd-number and even-number columns of the pixel columns connected to the row control lines 13 are each repeated in the filter order of the same colors, and the repeat unit of the color filters arranged in the even-number columns is shifted by 1½ pixels from the odd-number columns, i.e., a so-called delta arrangement.

In the column data line 14, pixels arranged in a staggered form are connected in units of the same colors. When this is done, the horizontal spacing frequency becomes twice improved and the resolution is improved when seen from the pixels in adjacent lines. Also, since the lines of the same colors are connected to the column electrode lines, the color switching circuit becomes unnecessary. Further, since the pixels of the same color are not arranged obliquely, the problem of the oblique color lines can be eliminated.

The arrangement shown in FIG. 3 as described above is used for a simplified electronic view finder (EVF) for field display, formed of about 230 pixels. In a field display of a display element which does not have such a high resolution as above, if the pixel sampling at every horizontal scanning is performed shifted by 1½ pixels, it is possible to make an image display free from problems.

FIG. 4 is a block diagram illustrating another example of an active matrix type color liquid-crystal display apparatus. Reference numeral 410 denotes a display element section; reference numeral 420 denotes a vertical scanning circuit for vertically scanning the display element section 410; reference numeral 430 denotes a sampling circuit for sampling input image signals and outputting them to the display element section 410; and reference numeral 440 denotes a horizontal scanning circuit.

The unit pixel of the display element section 410 is formed of a switching transistor 411, a liquid crystal and a pixel holding capacitance 412. The gate of the switching transistor 411 is connected to the vertical scanning circuit 420 through a gate line 413, and the input terminal of the switching transistor 411 is connected to the sampling circuit 430 through a vertical data line 414. The other terminal of the pixel holding capacitance 412 is connected to a common electrode line 412-A, to which terminal a common electrode voltage $V_{LC}$ is applied.

Color signals (red, blue, green) are supplied from a signal processing circuit 450 to the input of the sampling circuit 430. The signal processing circuit 450 performs gamma processing in which liquid crystal characteristics are taken into consideration, inverted signal processing for making the liquid crystal have a longer service life, and other processing on input image signals. In a control circuit 460, necessary pulses are formed which are supplied to the vertical scanning circuit 420, the horizontal scanning circuit 440, the signal processing circuit 450, and the like.

FIG. 5 is an equivalent circuit diagram of the display element section 410 and the sampling circuit 430. Each line is formed in the display element section 410 in such a way that R, G and B pixels corresponding to the different three colors red, green and blue are repeatedly arranged horizontally in sequence in the order of R, G and B, and a plurality of pixel lines arranged vertically are provided therein. The pixel positions of the same colors are shifted by 1.5 pixels between the adjacent lines. That is, the pixels (R, G and B) are arranged in a delta form, and pixels of the same colors are connected to each data line 414 (d1, d2 . . . ) at every other line at both sides of the vertical data line 414. The sampling circuit 430 comprises switching transistors SW1, SW2 . . . , and capacitance (the parasitic capacitance and pixel capacitance of the vertical data lines). When the gates of the switching transistors SW1, SW2 . . . are driven by pulses h1, h2 . . . from the horizontal scanning circuit 440, respectively, the signal of each color of an input signal line 416 is transferred to each pixel through the data line 414 (d1, d2 . . . ) and written. The selection of a row at that time is controlled by vertical pulses ϕg1 and ϕg2 . . . from the vertical scanning circuit 420.

FIG. 6 is an illustration of an interlace scanning in a liquid-crystal display apparatus having the same number of vertical pixels as that of a television. The pixels of each row (hereinafter referred to as row pixels) in the display element section are made to correspond to the vertical pulses ϕg1 and ϕg2 . . . , and designated by symbols g1, g2 . . . . In the odd-number fields, the signal of the horizontal scanning line odd1 is written in row pixels g2 and g3, and similarly the signal of the horizontal scanning line odd2 is written in row pixels g4 and g5. The row pixels are driven in units of two rows for odd3 and subsequent scanning lines. In the even-number fields, the scanning combination is shifted by one line, and the signal of even is written in row pixels g3 and g4. Similarly, the subsequent signals are written in units of two rows.

An example of a drive timing in a case in which the scanning example of FIG. 6 is applied to the example of FIG. 4 is shown in FIG. 7 (this drive method is called a two-line simultaneous drive). In the scanning line odd1 in the odd-number field, the vertical pixels g2 and g3 corresponding to the row pixels g2 and g3 reach "H" (high state), causing each of the switching transistors 411 of that row pixel to conduct. Thus, the image signals sampled in sequence by the sampling circuit 430 are written in each pixel of row pixels g2 and g3. This sampling is performed in the "H" period of the horizontal scanning pulses h1, h2 . . . . The scanning of odd2 and subsequent scanning lines is similarly performed.

In recent years, there has been an increasing demand for a liquid-crystal display element used, in particular, in an EVF or a liquid-crystal projector to have a higher resolution image. In an EVF or a liquid-crystal projector, for example, a panel having vertical 460 pixels or more is under development to obtain a higher resolution image. When television signals are displayed on a panel having vertical 460 pixels, as described above, first an interlace drive is considered. When alternating inverted drive is performed at a frequency of 30 Hz in interlace drive, a flicker of 15 Hz is generated. To reduce this flicker, it is necessary to drive each pixel at 60 Hz, i.e., a field frequency.

Accordingly, when field drive is performed in the construction shown in FIG. 2, a method of simultaneously driving two rows of pixels as in the example described above is conceivable. Although flicker can be reduced by a two-line simultaneous drive, the horizontal resolution is deteriorated since the same sampling signal is applied to pixels shifted by 1.5 pixels between two rows.

According to the two-line simultaneous drive, since the same sampling signal is written in the pixel separated spatially by 1.5 pixels of the two rows of pixels which are driven simultaneously, the drive method is simple. However, the sampling frequency is not improved, and color moire occurs at a low resolution. Also, the pixel-shifted arrangement in which the pixels are shifted by 1.5 pixels horizontally exerts an adverse influence such that the edge of the image is displayed zigzag by the driving on the basis of the combination of row pixels shifted by one line between the odd-number fields and the even-number fields.

Since the pixels of three colors (R, G and B) are sampled in a point sequential manner by the horizontal scanning pulses h1, h2 and h3, the drive frequency becomes high to a greater extent in a panel having a great number of pixels. For example, in a panel having about 600 horizontal pixels in an NTSC system, the sampling frequency for two rows in which the pixel-shifted arrangement is taken into consideration becomes about 20 MHz. It is required in the Hi-Vision display that the number of horizontal pixels be 1,500 or more. In that case, the sampling frequency becomes about 50 MHz or more. Even in a current TFT liquid crystal, the drivable frequency is 10-odd MHz. Therefore, a plurality of scanning circuits are required to drive a panel having a great number of pixels.

In this way, the two-line simultaneous (field shifted) drive method described above could deteriorate the resolution. Also, since the horizontal drive frequency is increased, a plurality of scanning circuits are required, causing a problem, for example, that a great number of drive pulses are required, causing an increase in the consumed electric current.

Accordingly, column a electrode line connection as shown in FIG. 8 which does not cause the horizontal resolution to deteriorate is conceivable. FIG. 8 shows an arrangement in which the number of the column data lines 14 is double and the same-color pixels are connected together. With such an arrangement, and when the sampling of two rows of pixels is shifted at $H_{1n}$ and $H_{2n}$, it is possible to eliminate the deterioration of the horizontal resolution.

However, an increase in the wiring of the column data lines causes the semiconductor process to be complex, and the aperture ratio of each pixel is greatly decreased. Therefore, when formation of such a fine structure is considered, the above construction cannot be said to be an appropriate one.

Also, a display method which displays a non-interlaced image by using a frame memory or a field memory is conceivable. Specifically, such a method entails a double-speed scanning in which the image signal is doubled and the frequency of the horizontal scanning is made twice as high and two horizontal row pixels are driven in sequence in one horizontal scanning period, as shown in FIG. 9.

An image improvement method of the above-described two-line simultaneous drive method includes such double-speed scanning. However, in the double-speed scanning, a frame memory and a high-band signal processing IC are required, a large amount of cost is incurred, and a large amount of power is consumed by the display apparatus.

SUMMARY OF THE INVENTION

It is an object of present invention to provide a liquid-crystal display apparatus and a method of driving the same liquid-crystal display apparatus, which apparatus solves the above-described problems and is capable of displaying a high-resolution and high-quality image.

It is another object of present invention to provide an active matrix type liquid-crystal display apparatus and a method of driving the same liquid-crystal display apparatus, which apparatus is capable of making pixels display a high-resolution and high-quality image, the number of which pixels is equal to the number of scanning lines of a television, by adding a simple circuit without using a frame memory.

It is a further object of present invention to provide a liquid-crystal display apparatus and a method of driving the same liquid-crystal display apparatus which is capable of making pixels display a high-resolution image by sampling image signals by a low horizontal drive frequency pulse, the number of which pixels is equal to or greater than the number of scanning lines of a television.

It is still a further object of present invention to provide a liquid-crystal display apparatus and a method of driving the same liquid-crystal display apparatus, which apparatus is able to easily switch colors and is capable of easily driving a high-resolution color liquid-crystal display apparatus, and in which colors are not mixed even if two colors are alternately placed in column data lines and which consumes a small amount of power because its horizontal scanning circuit can be operated at a normal drive frequency.

It is another object of present invention to provide a liquid-crystal display apparatus and a method of driving the same liquid-crystal display apparatus, which apparatus has higher horizontal and vertical resolution than in the prior art and is capable of displaying an image free from flicker.

It is still another object of present invention to provide a liquid-crystal display apparatus and a method of driving the same liquid-crystal display apparatus, which apparatus is capable of obtaining a high-resolution image by a simple construction in which two image input means are provided.

It is still a further object of present invention to provide an active matrix type liquid-crystal display apparatus and a method of driving the same liquid-crystal display apparatus, which apparatus consumes a small amount of power because no frame memory is used, has a small size and is inexpensive.

It is still a further object of present invention to provide a liquid-crystal display apparatus and a method of driving the same liquid-crystal display apparatus, which apparatus is capable of lengthening a sampling time by greatly decreasing the horizontal drive frequency, capable of performing a high-resolution display faithful to image signals, and capable of reducing power consumption.

To achieve the above-described objects, according to one aspect of the present invention, there is provided a liquid-crystal display apparatus comprising: a plurality of pixels, arranged in a matrix form, each of which has a switching element; a horizontal scanning circuit for generating a signal used to sample an image signal supplied to the pixel; a vertical scanning circuit for selecting the line of the pixel; first writing means including a first horizontal scanning circuit disposed in one side of a plurality of data lines connected in common to the rows of the pixels; a second horizontal scanning circuit disposed in one side of the data lines; a second writing means having storing means for storing image signals sampled by the second horizontal scanning circuit.

According to another aspect of the present invention, there is provided a liquid-crystal display apparatus, wherein horizontal pixel lines in which pixels corresponding to three different colors are repeatedly arranged horizontally in sequence in a predetermined order are arranged vertically in a plurality of lines as a result of pixels corresponding to the same color of the adjacent lines being shifted by a predetermined amount, and adjacent two vertical pixels of the pixel columns which are formed at every other line and correspond to the same color are connected to the same column data line, a memory circuit for storing image information and a horizontal scanning circuit for supplying the image information stored in each of the memory circuits to the memory circuit being disposed at both ends of the column data lines.

According to a still another aspect of the present invention, there is provided a method of driving a liquid-crystal display apparatus comprising: a plurality of pixels, arranged in a matrix form, each of which having a switching element; a horizontal scanning circuit for generating a signal used to sample an image signal supplied to the pixel; and a vertical scanning circuit for selecting the row of the pixel, the method comprising the steps of: (a) writing image data sampled by the first horizontal scanning circuit disposed in one side of a plurality of data lines connected in common to the pixel rows at a first row of the row of the pixels; (b) storing image data sampled by the second horizontal scanning circuit disposed in one side of the data lines; and (c) writing the stored image data in the row which is the row of the pixel and is adjacent to the first row.

According to a further aspect of the present invention, there is provided a method of driving a liquid-crystal display apparatus, wherein horizontal pixel lines in which pixels corresponding to three different colors are repeatedly arranged horizontally in sequence in a predetermined order are arranged vertically in a plurality of lines as a result of pixels corresponding to the same color of the adjacent lines being shifted by a predetermined amount, and adjacent two vertical pixels of the pixel columns which are formed at every other line and correspond to the same color are connected to the same column data line, the method comprising the steps of: distributing information signals having image information to the upper and lower portions for each information signal corresponding to the colors of the pixels connected to the column data lines, and supplying the signals to the corresponding pixels.

The above and further objects, aspects and novel features of the invention will more fully appear from the following detailed description when read in connection with the accompanying drawings. It is to be expressly understood, however, that the drawings are for the purpose of illustration only and are not intended to limit the invention.

DETAILED DESCRIPTION OF THE PREFERRED EMBODIMENTS

Preferred embodiments of the present invention will be explained below with reference to the accompanying drawings.

[First Embodiment]

Figure 10:
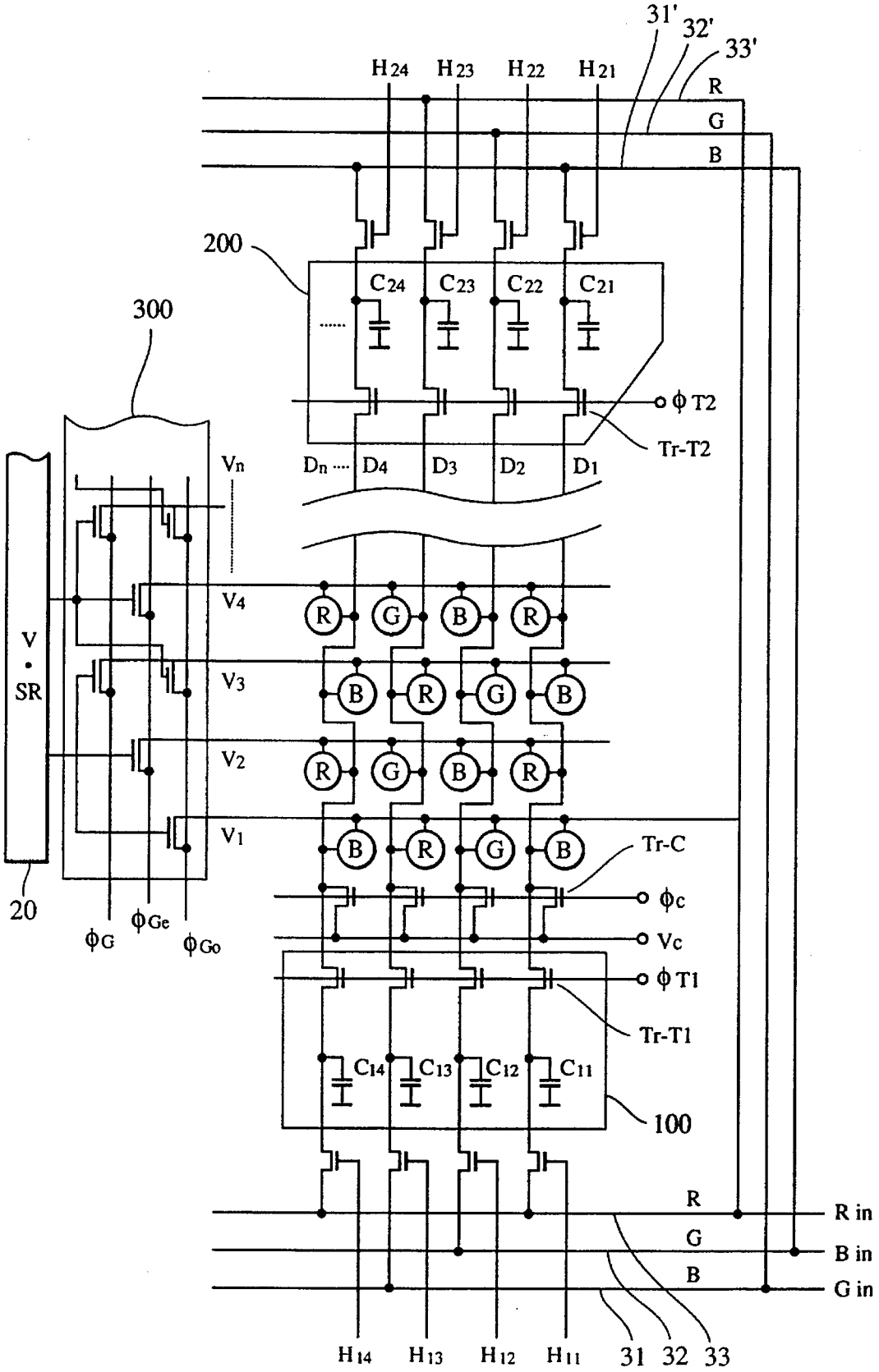
FIG. 10 is a schematic diagram illustrating an example of a liquid-crystal display apparatus in accordance with the present invention.

FIG. 10 is a schematic diagram illustrating a preferred embodiment of the present invention. Reference numerals 31, 32 and 33, 31', and 32' and 33' each denote a signal line having color information corresponding to the filters of the pixels of each of the colors (R, G and B); reference numerals 100 and 200 denote each a memory circuit for sampling the signals of the signal lines 31, 32 and 33, and 31', 32' and 33', respectively, and storing the signals; and reference numeral 300 denotes an interlace circuit. From these elements, a drive signal is supplied to each pixel. Each pixel is provided with a switching transistor for applying a drive signal to a liquid crystal, a pixel electrode and a filter.

As shown in FIG. 10, the pixels of each line are arranged repeatedly in sequence in the order of R, G and B, and the pixels of the adjacent lines are arranged shifted by ½ of the repeat pitch from each other. In this manner, the above-described delta arrangement is formed. As a result, the pixels of the same colors are arranged shifted by 1.5 pixels (for 1½ pixels) between the adjacent lines. Pixels are connected to column data lines D1, D2, . . . $D_n$ in such a way that the colors of the corresponding pixels in each line become any one of a B and R, G and B, and R and G combination. In FIG. 10, the pixels are distributed so that the pixels of one of the colors of any set of B and R, G and B, and R and G are positioned in the left side and the other are positioned in the right side with respect to column data line $D_n$. Also, a reset switch Tr-c for resetting the remaining charge of the column data lines is connected to each of column data lines D1, D2, . . . $D_n$, a reset pulse $\phi c$ being applied to its gate line and a reset electrical potential Vc being applied to the source. In addition, the column data lines D1, D2, . . . $D_n$ are connected to the memory circuits 100 and 200 for supplying a signal of each color. The memory circuits 100 and 200 have capacitor arrays C1n and C2n, which are storing means, and transfer switch arrays Tr-T1 and Tr-T2, respectively.

The transfer of signals from the memory circuits 100 and 200 to the column data lines D1, D2, . . . $D_n$ is controlled by transfer pulses $\phi$T1 and $\phi$T2 applied to each gate of the transfer switch arrays Tr-T1 and Tr-T2, respectively. An R signal is stored in a memory C11 connected to column data line D1, and a B signal is stored in a memory C21. Similarly, a B signal is stored in a memory C12 of column data line D2 and a G signal is stored in a memory C22. Outputting of signals from the signal lines 31, 32 and 33, 31', and 32' and 33' to the memory circuits 100 and 200 is controlled by bit pulses $H_{1n}$ and $H_{2n}$ from a horizontal shift register, respectively.

A line control line Vn connected to the gate of the switching transistor of each pixel is connected to an interlace control circuit 300. The gate electrode of the switching transistors of the interlace control circuit 300 is connected to the vertical scanning circuit 20, gate pulses $\phi$Go, $\phi$Ge and $\phi$G being applied to the source electrode, respectively.

Figure 11:
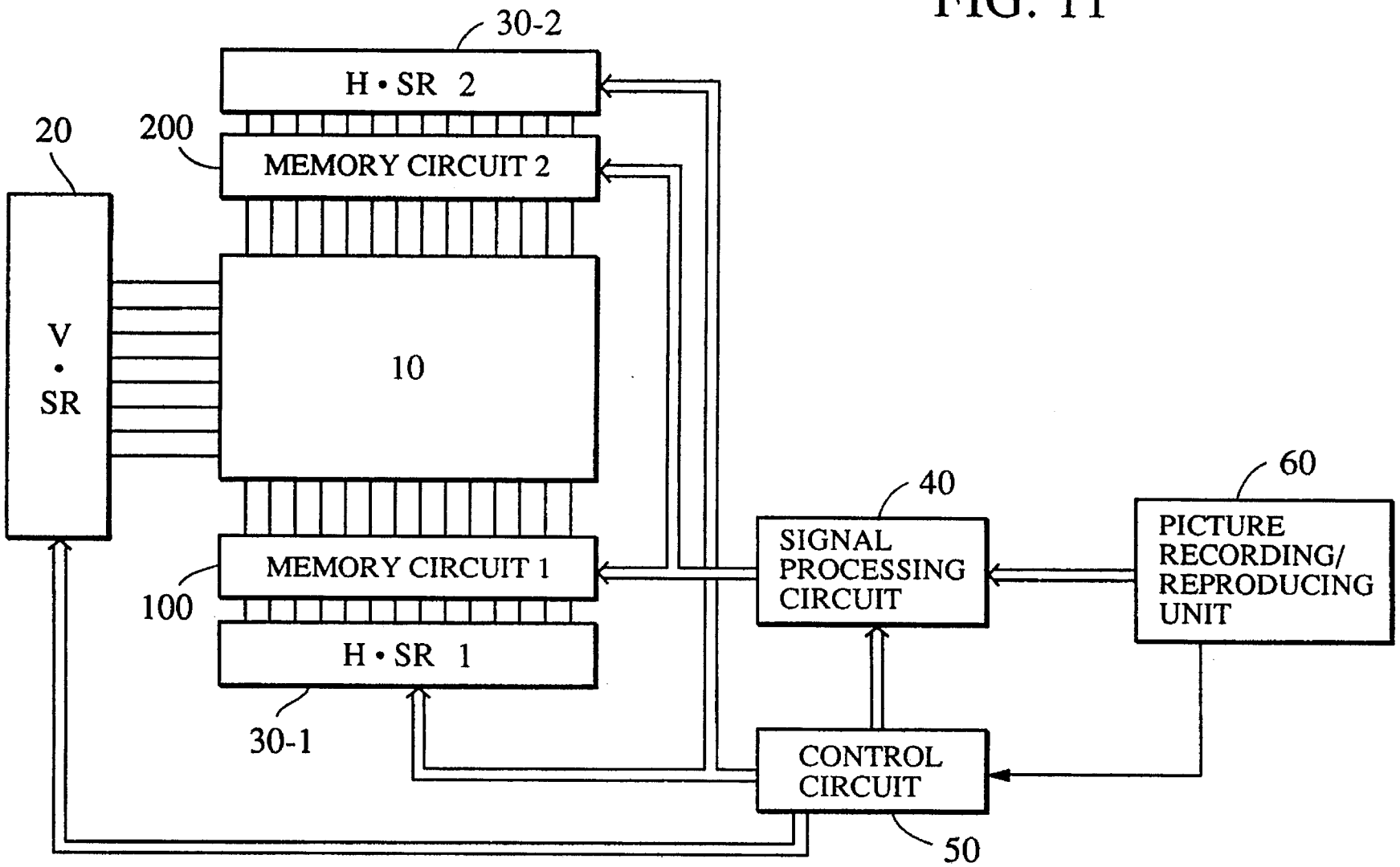
FIG. 11 is a schematic block diagram of the liquid-crystal display apparatus in accordance with the present invention.

FIG. 11 is a schematic block diagram of the embodiment shown in FIG. 10. The horizontal scanning circuits 30-1 and 30-2, and memory circuits 100 and 200 are disposed respectively in the upper and lower portions of the panel (liquid-crystal display element) 10. The signals from a picture recording/reproducing unit 60 are input to both the signal processing circuit 40 and the control circuit 50, and the signals from the control circuit 50 are input to both the horizontal scanning circuits 30-1 and 30-2. The signals from the signal processing circuit 40 are input to both the memory circuits 100 and 200, which are distributed to two portions similarly to that described above. Further, the signals from the control circuit 50 are also input to the vertical scanning circuit 20 and the signal processing circuit 40.

Figure 12:
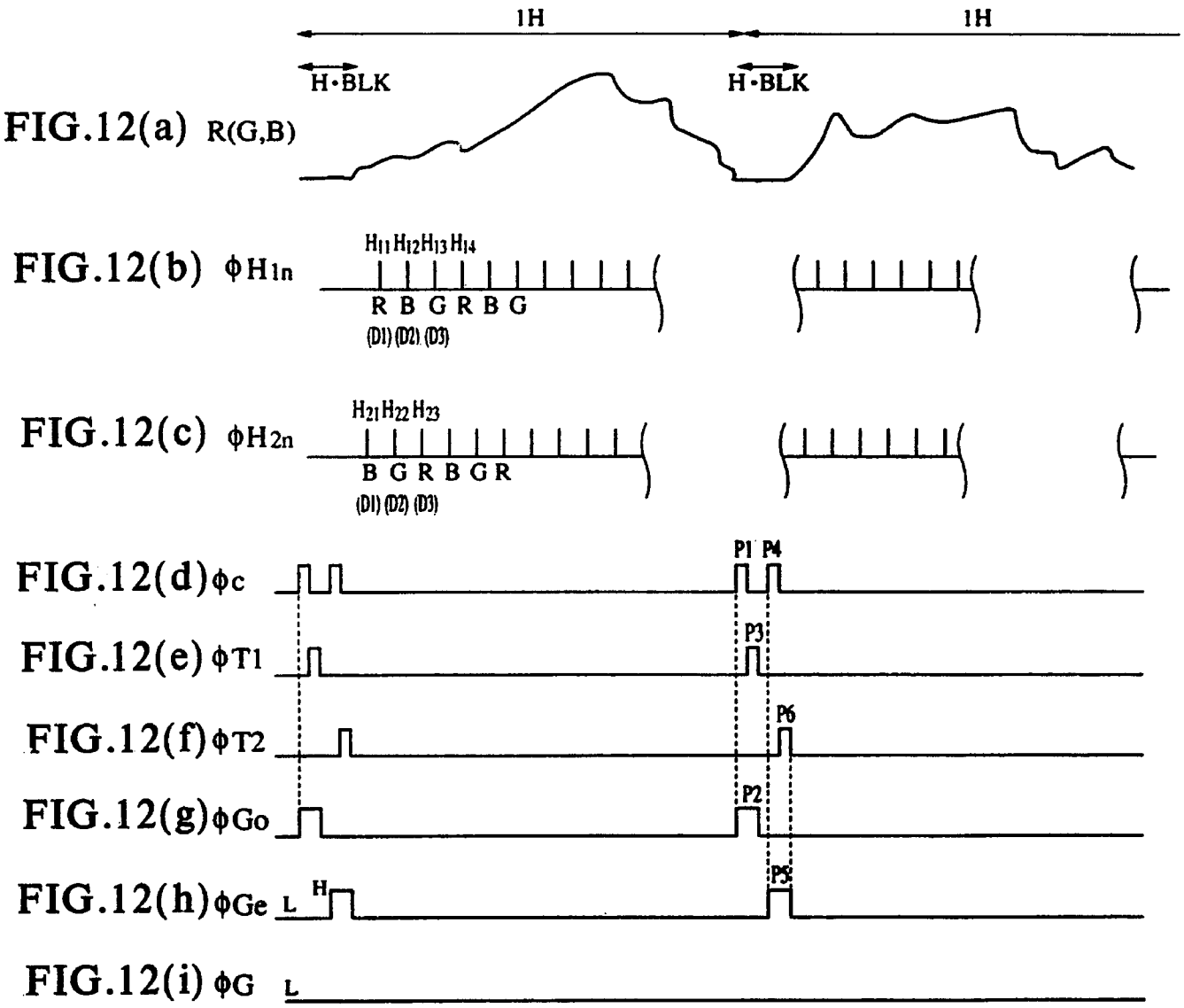
FIG. 12 is a timing chart illustrating an example of a method of driving the liquid-crystal display apparatus in accordance with the present invention.

FIG. 12 is a timing chart illustrating the embodiment shown in FIG. 10. R (G and B) shown in the figure designate signals input to the signal lines 31 to 33, and 31' to 33'. Each of the color signals is stored temporarily in the memories 100 and 200 in accordance with pulses $\phi H_{1n}$ and $\phi H_{2n}$ of the horizontal scanning circuit. R, B and G signals are each sampled in sequence by pulse $\phi H_{1n}$, and B, G and R signals are each sampled in sequence by pulse $\phi H_{2n}$. As shown, $\phi H_{1n}$ is 180 degrees out of phase with $\phi H_{2n}$.

When the horizontal effective scanning period is terminated, gate pulse ϕGo (P2) is applied to the row control line (gate line) V1, and a reset pulse ϕc (P1) is applied at the same time. Therefore, the pixel connected to the row control line V1 and the column control line is reset to electrical potential Vc.

Although the reset electrical potential is preferably a black electrical potential, it may be an intermediate electrical potential of an inverted signal. Next, ϕc is turned off, and transfer pulse ϕT1 (P3) is turned on so that the signal charge of the memory 100 is written in the pixel connected to the gate line V1.

Subsequently, the gate pulse reset ϕGe (P5) is applied to the gate line V2, and the reset pulse ϕc (P4) is applied thereto, causing the pixel and the column electrode line to be reset. Then, pulse ϕT2 (P6) is turned on, causing the signal charge of the memory 200 to be written in the pixel connected to the gate line V2. In the next field, gate pulses ϕGe and ϕG are applied (not shown) to the interlace control circuit 300 so that interlace drive is performed.

With such a construction, it is possible to display an image having excellent horizontal and vertical resolutions and free from flicker.

[Second Embodiment]

Figure 13:
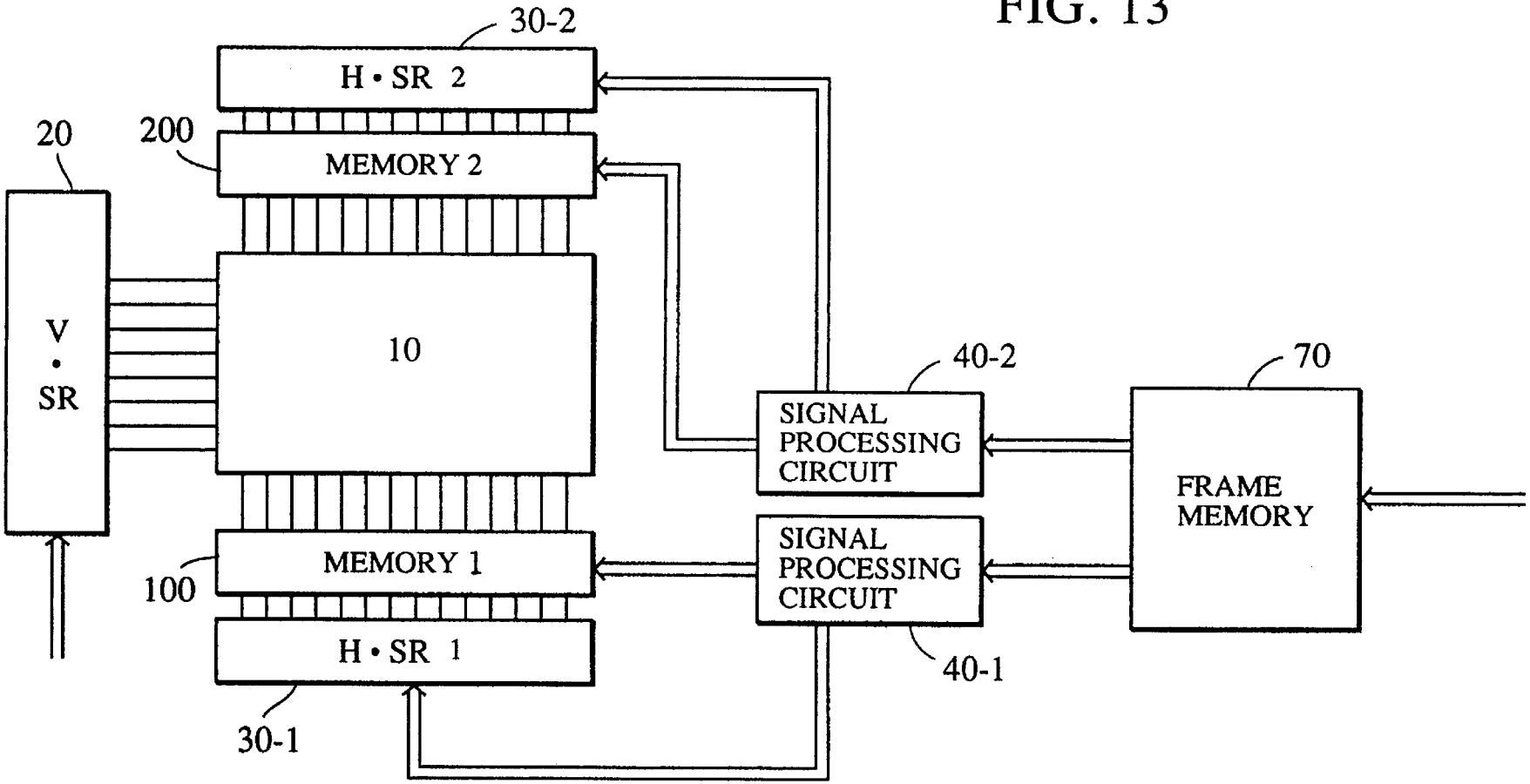
FIG. 13 is a schematic block diagram of the liquid-crystal display apparatus in accordance with the present invention.

FIG. 13 shows another preferred embodiment of the present invention.

In this embodiment, the panel construction is the same as that shown in FIG. 10, but input signals are different. More specifically, although in the above-described embodiment, the same signals of R, G and B are written in two lines of pixels in a state in which the sampling phase is varied, in this embodiment, odd-number field signals are stored in the memory 100 and even-number field signals are stored in the memory 200 from the frame memory 70, and both the odd- and even-number field signals are displayed at the same time. Based on this drive, it is possible to obtain an excellent image having high horizontal and vertical resolutions and free from flicker.

[Third Embodiment]

Still another preferred embodiment of the present invention will be explained.

Figure 14:
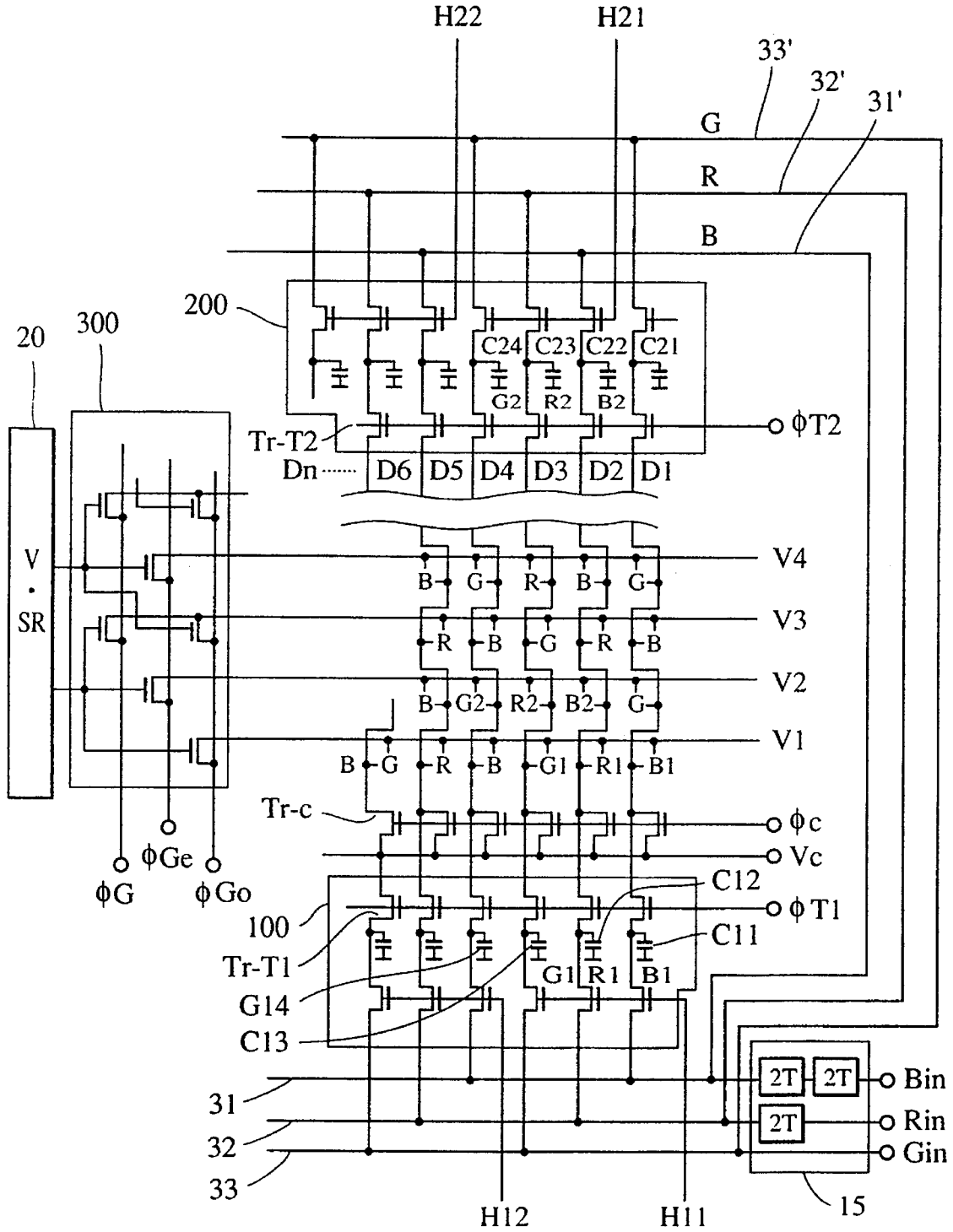
FIG. 14 is a schematic diagram illustrating an example of a liquid-crystal display apparatus in accordance with an embodiment of the present invention.

FIG. 14 is a schematic diagram illustrating this embodiment. The reference numerals in FIG. 14 which are the same as those in FIG. 10 indicate the same member or function. The difference between FIG. 14 and FIG. 10 is that a delay circuit 15 is provided in this embodiment, and pulses $H_{1n}$ and $H_{2n}$ are applied in correspondence with a plurality of switches. In FIG. 14, column data lines D1, D2, . . . $D_n$ are each so designed that any one of a B and G, R and B, and G and R combination is formed, and distributed so that one of them is on the left side and the other on the right side.

Specifically, reference numeral 15 denotes a delay circuit. A delay time 2T is a space sampling cycle between one line of pixels, which is about 90 ns when the number of horizontal pixels is 600. Since the B and R signals are made in phase with the G signal, the delay of the B signal becomes 4T, which corresponds to two pixels, and the delay of the R signal becomes 2T, which corresponds to one pixel. As a result, video signals can be stored in the memory 100 or 200 in units of three pixels in one operation.

That is, pulses $H_{1n}$ and $H_{2n}$ are each applied in parallel to three switches, and R, G and B signals are sampled simultaneously in accordance with this pulse and then temporarily stored in the memory. For example, B1, R1 and G1 signals are stored in the capacitors C11, C12 and C13, and B2, R2 and G2 signals are stored in the capacitors C22, C22 and C23.

Figures 15A, 15B, 15C, 15D, 15E, 15F, 15G, 15H, 15I:
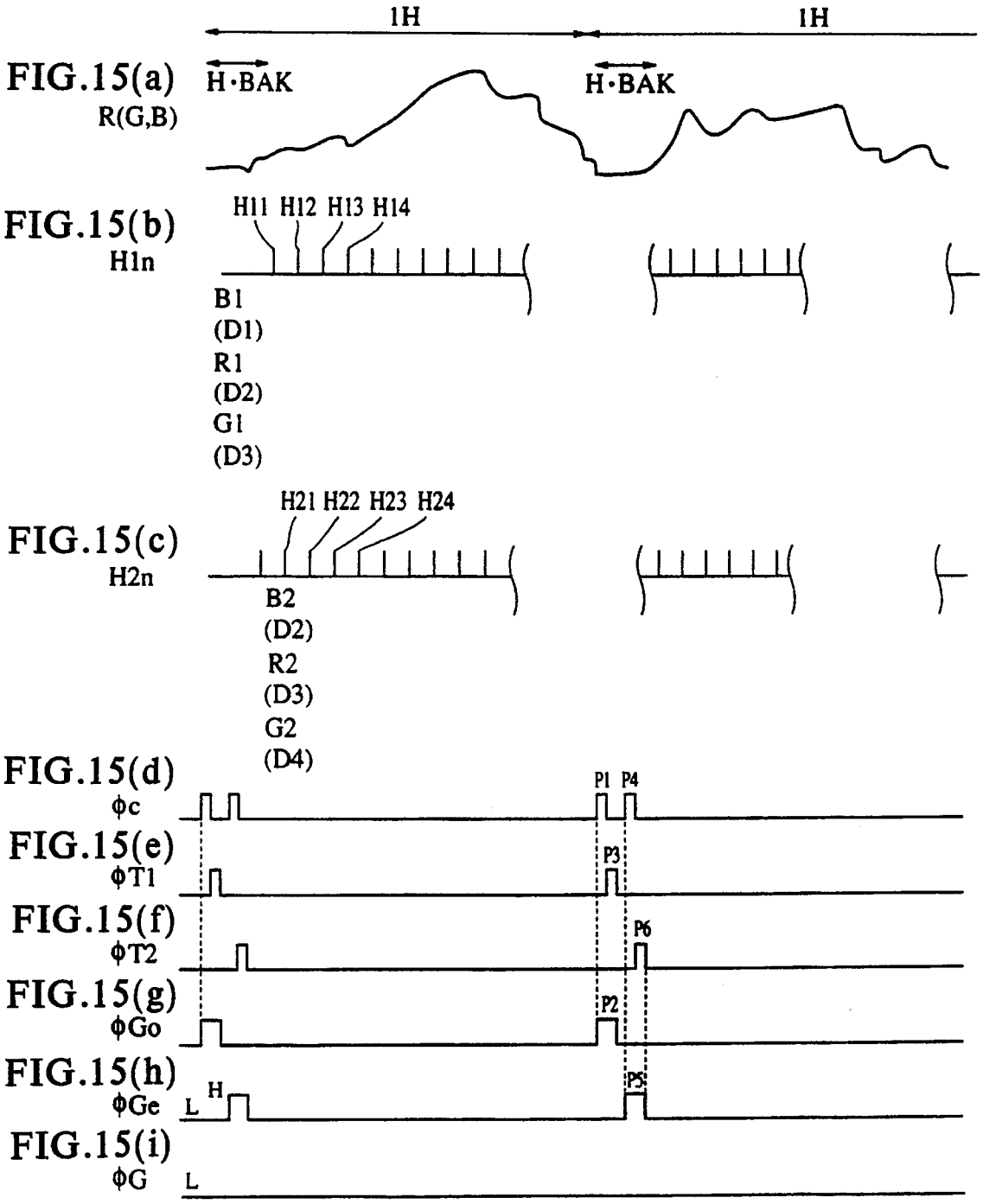
FIG. 15 is a timing chart of each signal in the embodiment shown in FIG. 14.

FIG. 15 is a timing chart of each signal in the embodiment shown in FIG. 14. R (G and B) shown in the figure designate signals input to the signal lines 31 to 33, and 31' to 33'. Each color signal is stored temporarily in the memories 100 and 200 in accordance with the pulses $H_{1n}$ and H2n from the horizontal scanning circuit 30-1. The B, R and G signals are simultaneously sampled in accordance with pulse H1n, and the B, R and G signals are simultaneously sampled in accordance with pulse H2n . As shown in the figure, H1n is 180 degrees out of phase with H2n.

When the horizontal effective scanning period is terminated in this manner, gate pulse ϕGo (P2) is applied to the row control line (gate line) V1, and a reset pulse ϕc (P1) is applied at the same time. Therefore, the pixel connected to the row control line V1 and the column control line are reset to electrical potential Vc. Although the reset electrical potential is preferably a black electrical potential, it may be an intermediate electrical potential of an inverted signal. Next, ϕc is turned off, and transfer pulse ϕT1 (P3) is turned on so that the signal charge of the memory 100 is written in the pixel connected to the gate line V1.

Subsequently, the gate pulse reset ϕGe (P5) is applied to the gate line V2, and the reset pulse ϕc (P4) is applied thereto, causing the corresponding pixel and the corresponding column electrode line to be reset. Then, pulse ϕT2 (P6) is turned on, causing the signal charge of the memory 200 to be written in the pixel connected to the gate line V2. The same operation is repeatedly performed for one field period. In the next field, gate pulses ϕGe and ϕG are applied (not shown) to the interlace control circuit 300 so that interlace drive is performed.

With such a construction, it is possible to display an image of very high horizontal and vertical resolutions and free from flicker.

The construction of FIG. 11 is applicable to the schematic block diagram of this embodiment. In this case, a signal delay circuit may be disposed in the signal processing circuit 40. Of course, the signal delay circuit may be disposed separately from the signal processing circuit 40. The illustration of the interlace control circuit 300 is omitted in FIG. 11.

In other words, in this embodiment, a signal from the signal delay means 15 which synchronizes the timing of sampling image signals of each color is supplied to the above-mentioned memory circuit. Also, the drive signal supplying means scans the line of each pixel by interlace scanning and supplies a drive signal, and has two memory circuits provided in the upper and lower portions. signals sampled by these are supplied to the drive signal applying means for applying signals to two lines of adjacent pixels which are scanned in pairs.

[Fourth Embodiment]

Next, a description will be given of another preferred embodiment of the present invention, which is a modification of the above-described embodiment. In this embodiment, an explanation will be given in which the panel construction is the same as that shown in FIG. 14, but in which input signals are different. The schematic block diagram of this embodiment is similar to FIG. 13 described above.

Although in the above-described embodiment, the same signals of R, G and B are written in two lines of pixels in a state in which the sampling phase is varied, in this embodiment, odd-number field signals are stored in the memory 100 and even-number field signals are stored in the memory 200 from the frame memory 70, and both the odd- and even-number field signals are displayed at the same time.

In this embodiment, the drive signal supplying means supplies simultaneously sampled signals of each color to the drive signal applying means for one line or adjacent two lines of pixels. In this case also, B and G signals are delayed by the delay circuit 15, making it possible to handle a plurality of pixels in one operation. Based on this drive, it is possible to obtain very high image performance at the horizontal and vertical resolutions and an excellent image free from flicker.

More specifically, in this embodiment, the above-described memory circuit is provided with a means 801 for distributing synchronized image signals of each color in order to delay the signals, and samples the delayed signals together with the synchronized image signals of each color. It is preferable in the above-described embodiment that the sampling timings in the two memory circuits described above be shifted by ½ cycle from each other, and the horizontal displacement between the adjacent lines be one half of the repeat pitch.

In the above-described third embodiment, since signals of each color are sampled simultaneously, the circuitry is not complex, the sampling frequency is reduced, and the sampling period is lengthened in comparison with a case in which the signals are sampled for each signal of each color. Therefore, a display more faithful to the input image signals is made, sampling pulses are reduced, and power consumption is reduced.

Still another embodiments of the present invention are shown in FIGS. 16 to 19.

[Fifth Embodiment]

Figure 16:
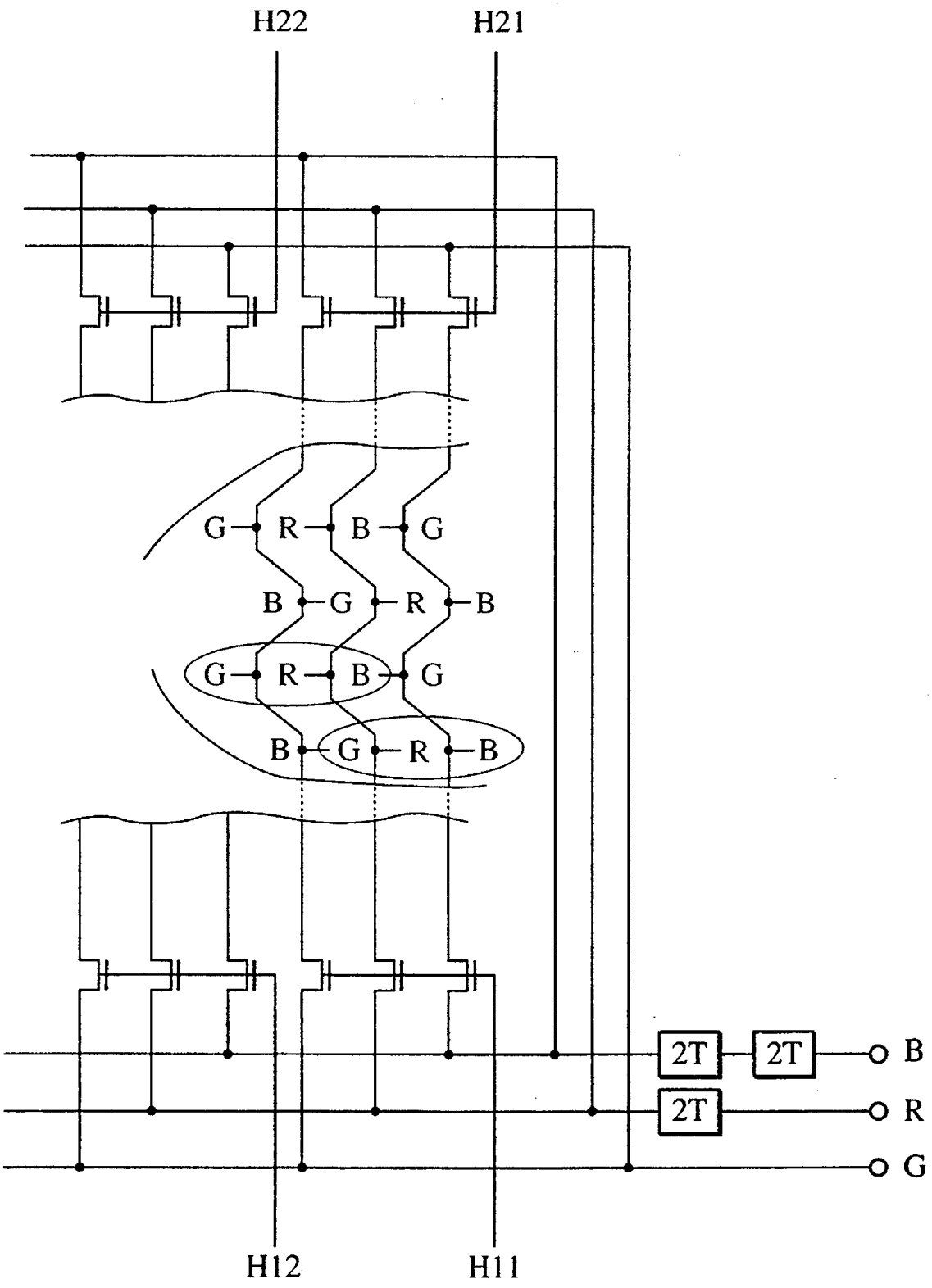
FIG. 16 is a schematic diagram of an embodiment in which the embodiment of FIG. 14 is modified in such a way that the connection of pixels to a vertical signal line is changed.

FIG. 16 shows a modification of the embodiment shown in FIG. 14, in which the connection of the pixels to the column data lines is changed so that the pixels of the same color are connected to one column data line alternately on the right and left for each line.

[Sixth Embodiment]

Figure 17:
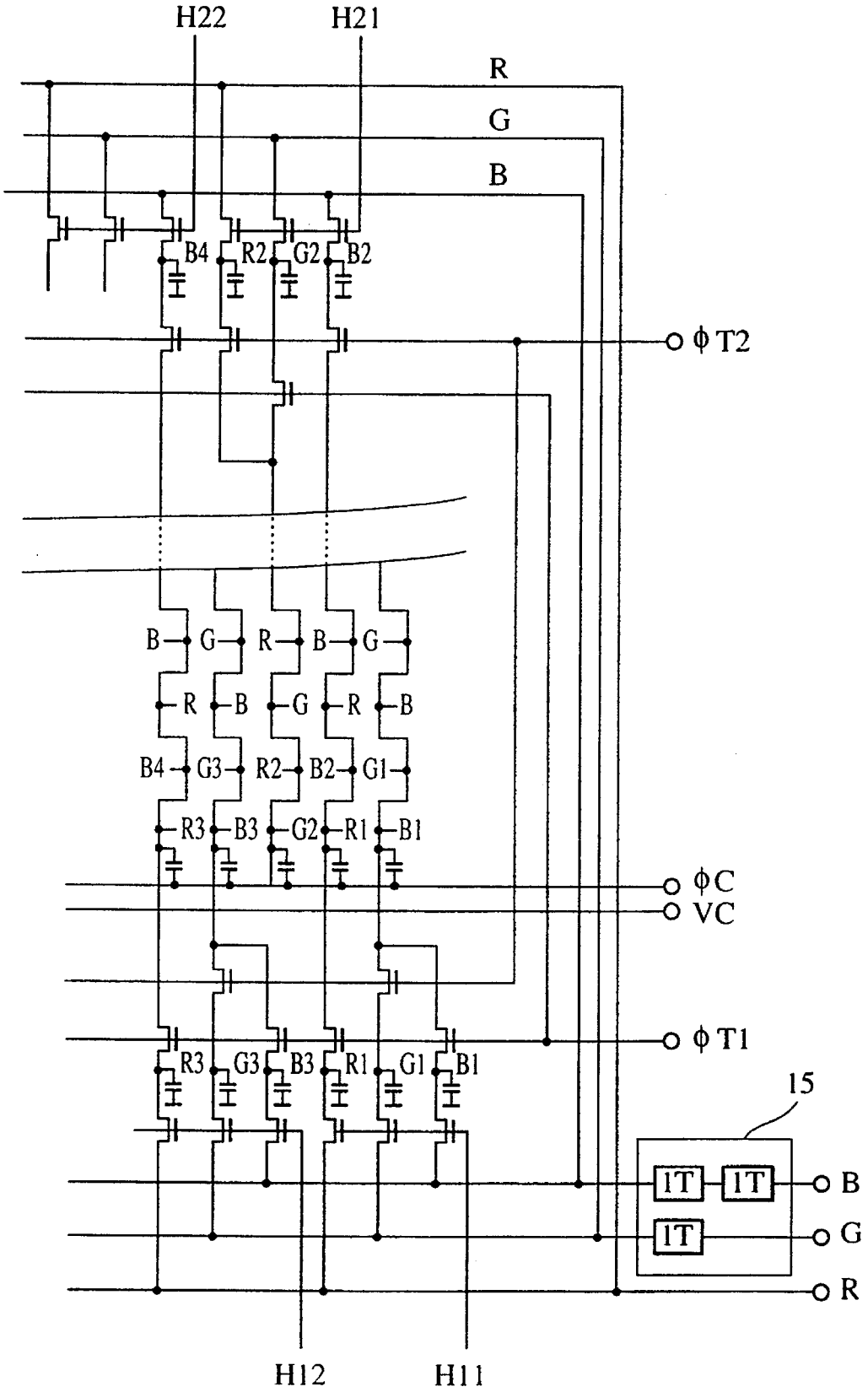
FIG. 17 is a schematic diagram of an embodiment in which color signals are sampled simultaneously for two lines of pixel columns.

FIG. 17 shows an example in which color signals are sampled simultaneously for two lines of pixel columns. In this embodiment, since two lines of pixel signals B1, R1 and G1 (B2, R2 and G2) are sampled at the same time and the horizontal spatial sampling frequency becomes one half of that of the embodiment of FIG. 14, the delay time of the delay circuit 15 becomes one half (however, the substantial spatial sampling frequency of two lines is equal to that of the embodiment of FIG. 14). Therefore, when the delay circuit 15 is formed of an analog circuit, a high-quality image can be obtained because a signal having a shorter delay time has generally high phase characteristics.

[Seventh Embodiment]

Figure 18:
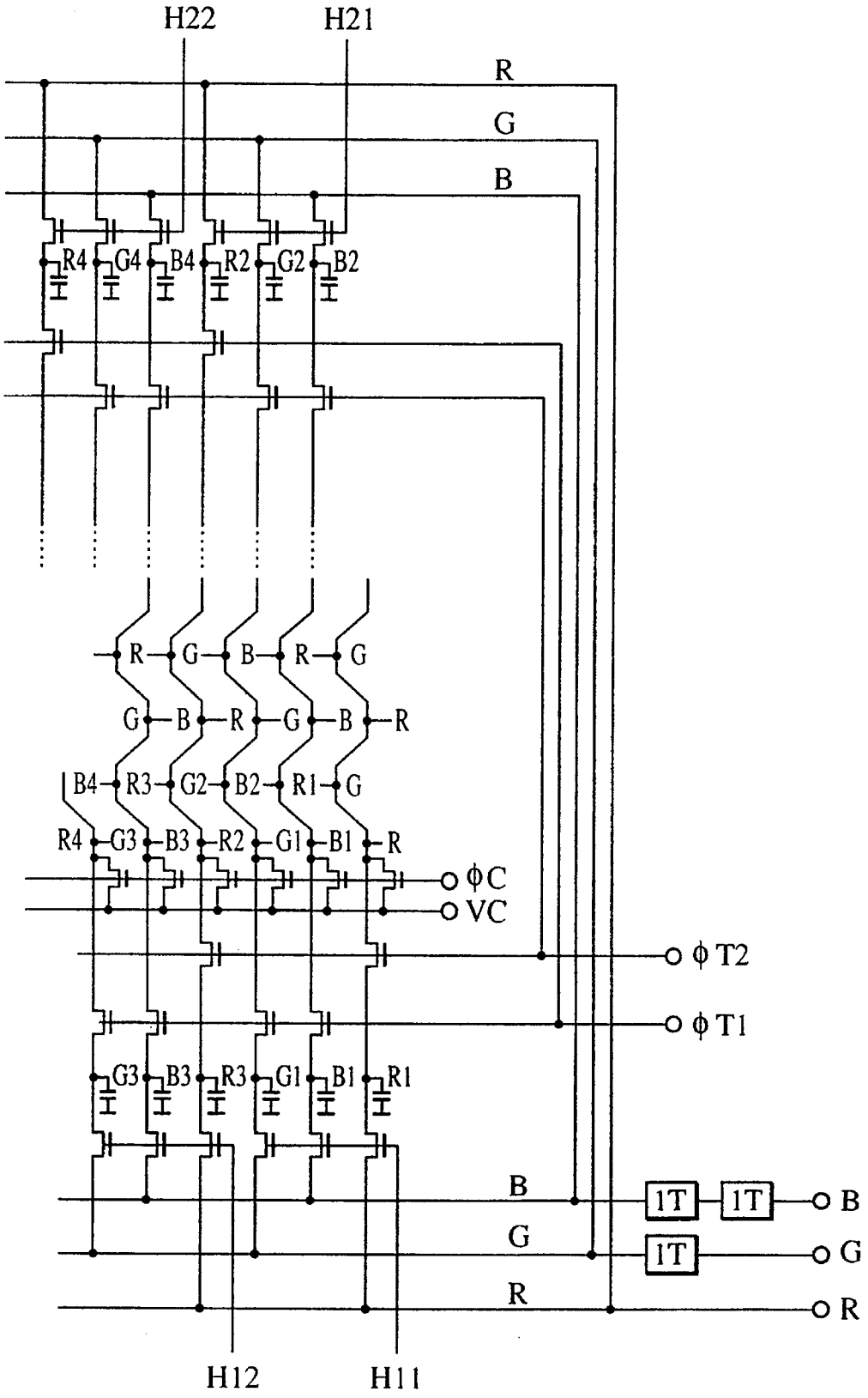
FIG. 18 is a schematic diagram of another embodiment in which color signals are sampled simultaneously for two lines of pixel columns.

FIG. 18 shows an embodiment in which the method of connecting pixels is the same as that of the embodiment shown in FIG. 16. Since color signals of two lines of pixel columns are sampled simultaneously, this embodiment has the same advantage as the embodiment shown in FIG. 17.

[Eighth Embodiment]

Figure 19:
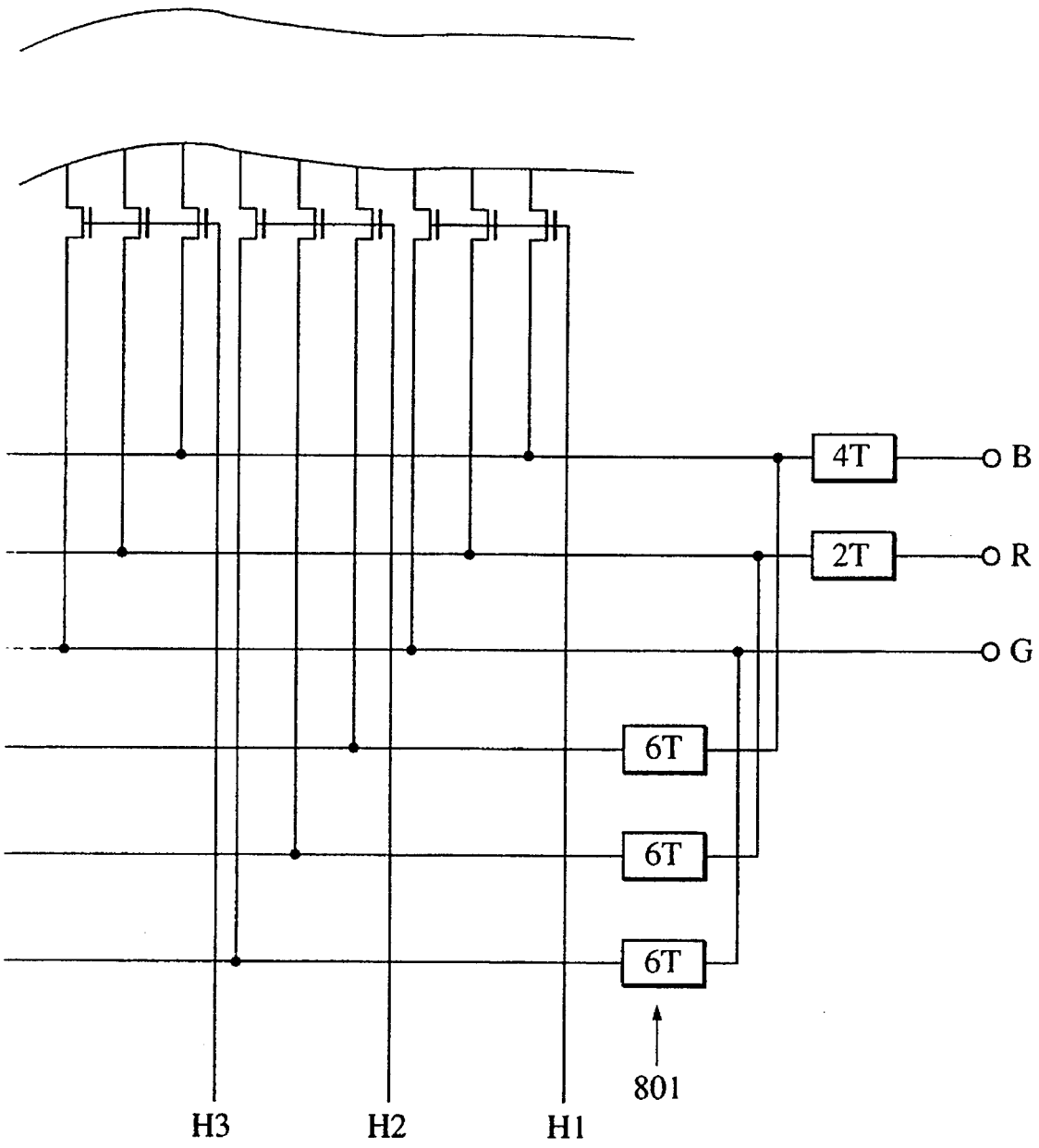
FIG. 19 is a schematic partial diagram of an embodiment in which three signal lines of R, G and B are formed into six signal lines via a delay circuit.

FIG. 19 shows an embodiment in which, to further reduce the drive frequency of the horizontal scanning, the three signal lines of B, R and G are formed into six signal lines via a delay circuit 801 for 6T. In this embodiment, when sampling is performed simultaneously from these six signal lines, the horizontal drive frequency becomes one half even further.

[Ninth Embodiment]

Although the above-described embodiments describe an example in which image signals are distributed to the memory circuits 100 and 200, respectively, only one of the memory circuits 100 and 200 may be provided.

Figures 1A, 1B:
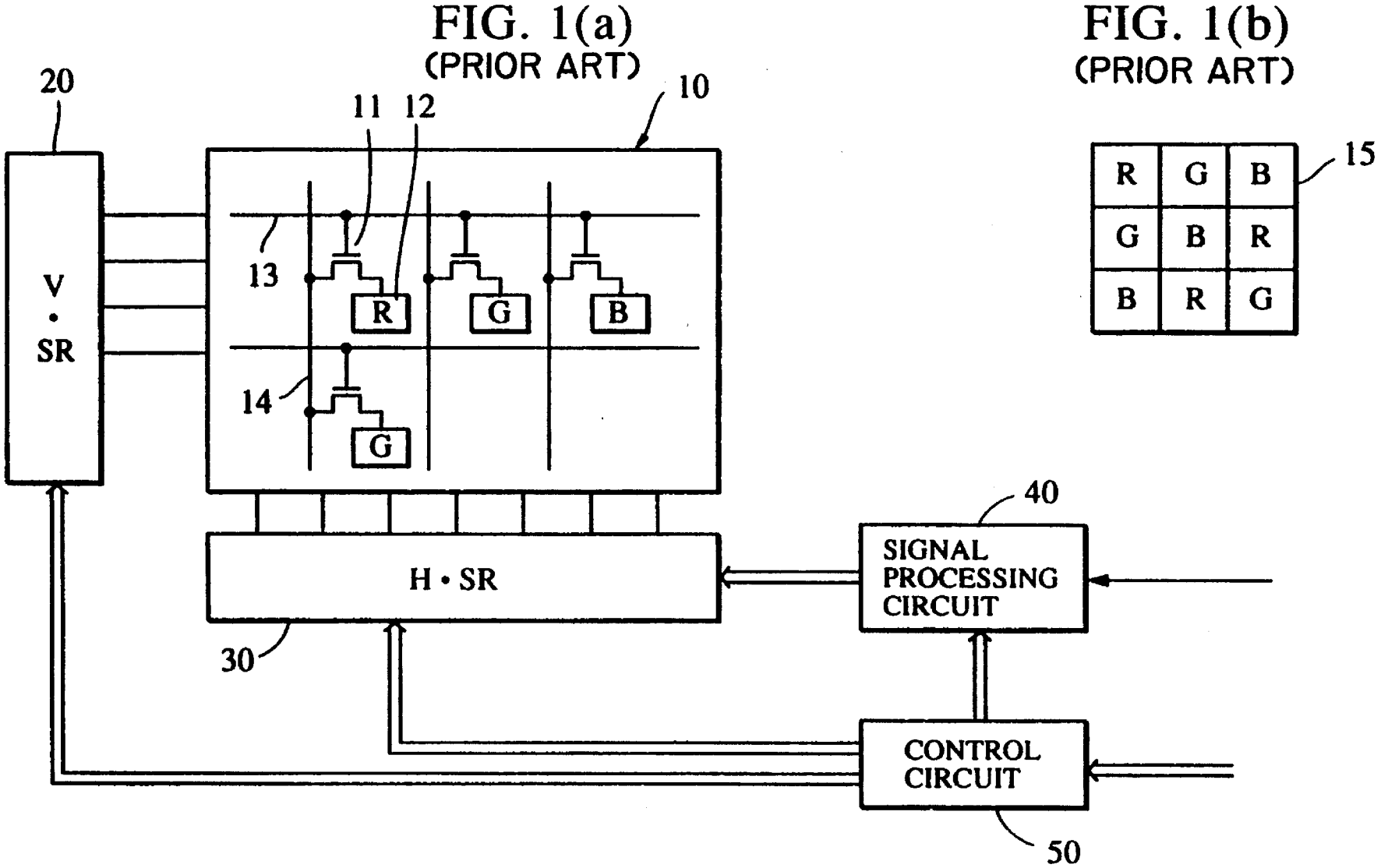
FIG. 1(b) (PRIOR ART)
FIG. 1(a) (PRIOR ART)
FIGS. 1(*a*) and 1(*b*) are illustrations of an example of a liquid-crystal display apparatus.
Figure 2:
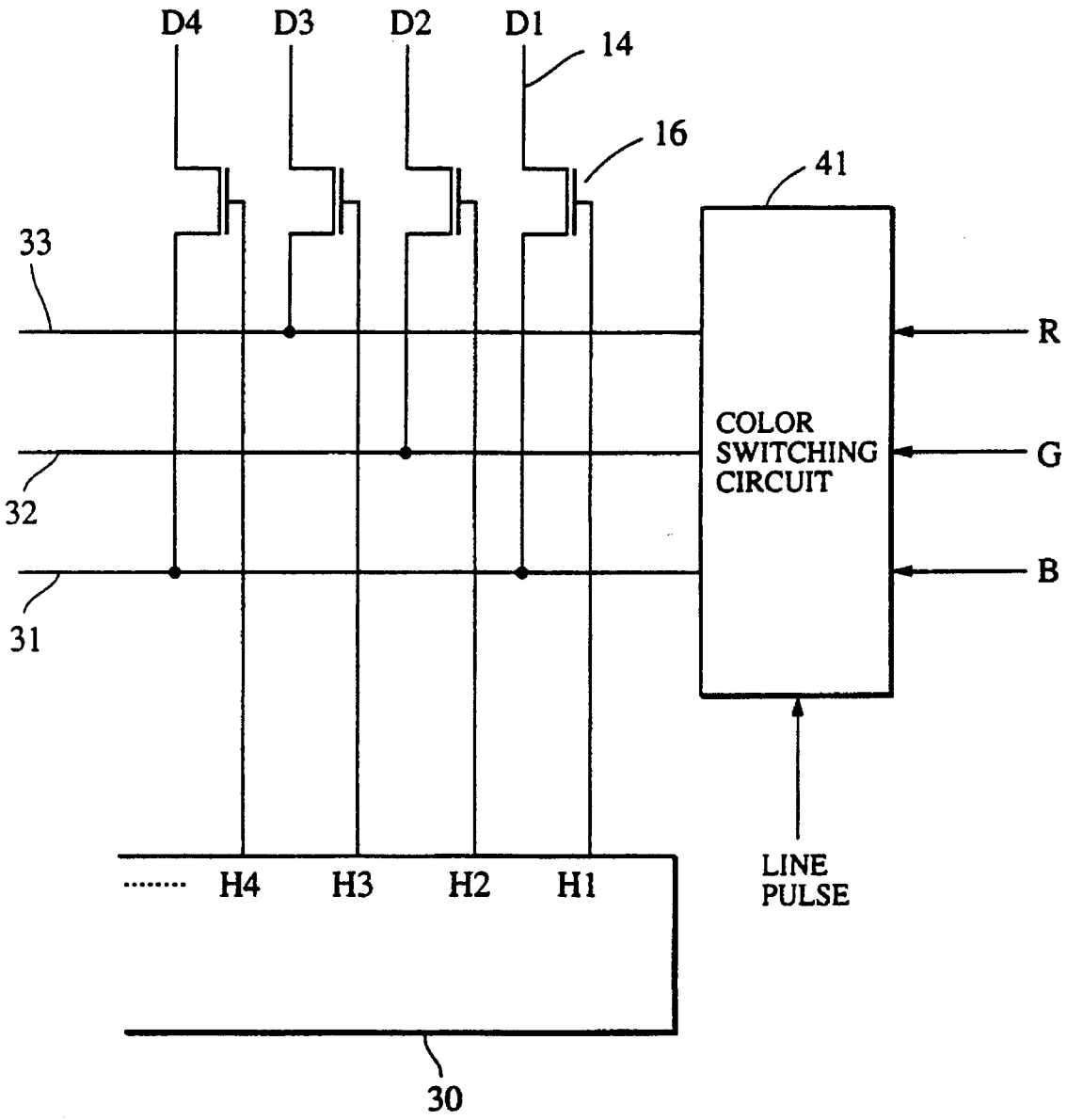
FIG. 2 (PRIOR ART)
FIG. 2 is an illustration of a method of driving the liquid-crystal display apparatus shown in FIG. 1.
Figure 3:
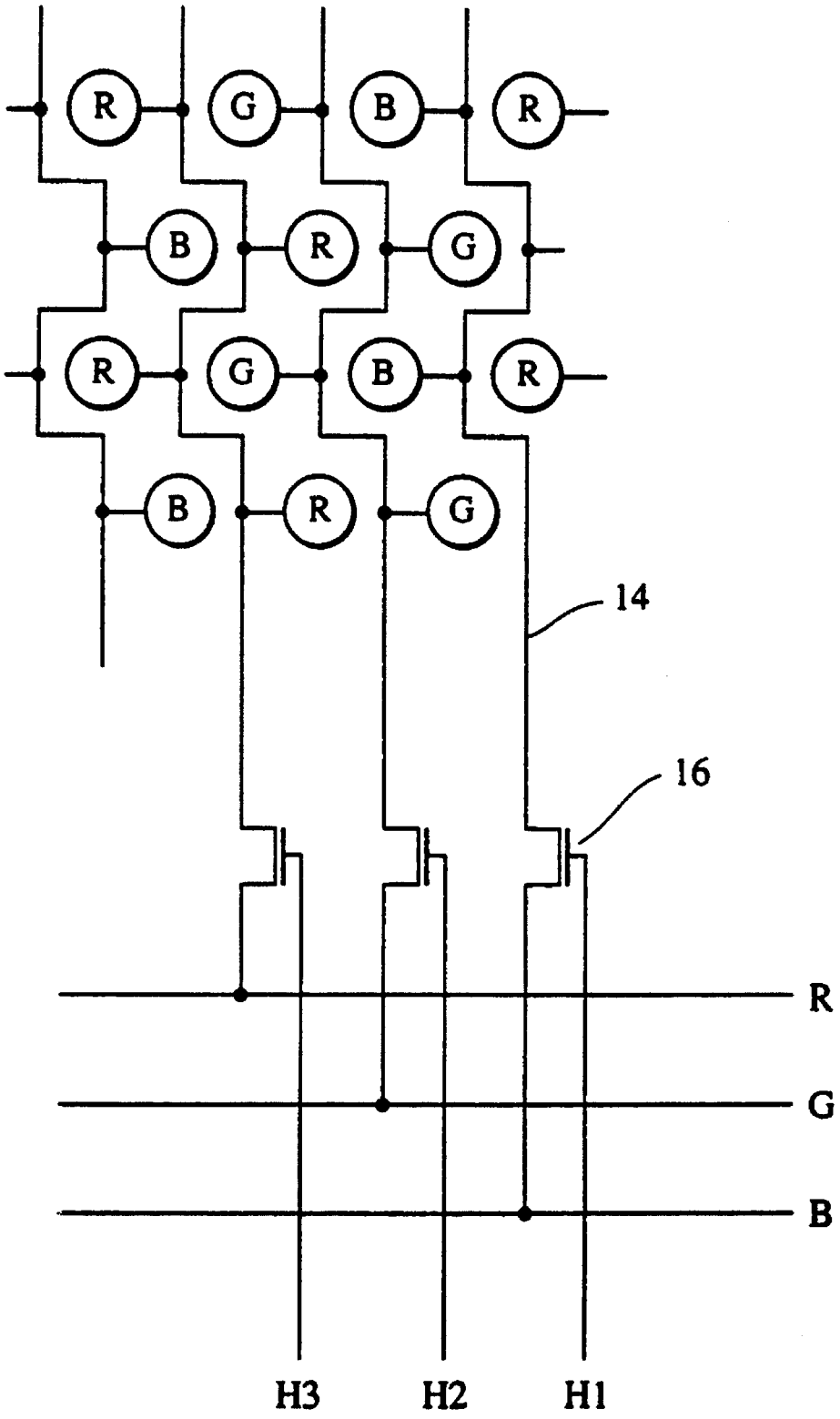
FIG. 3 (PRIOR ART)
FIG. 3 is an illustration of another liquid-crystal display apparatus.
Figure 4:
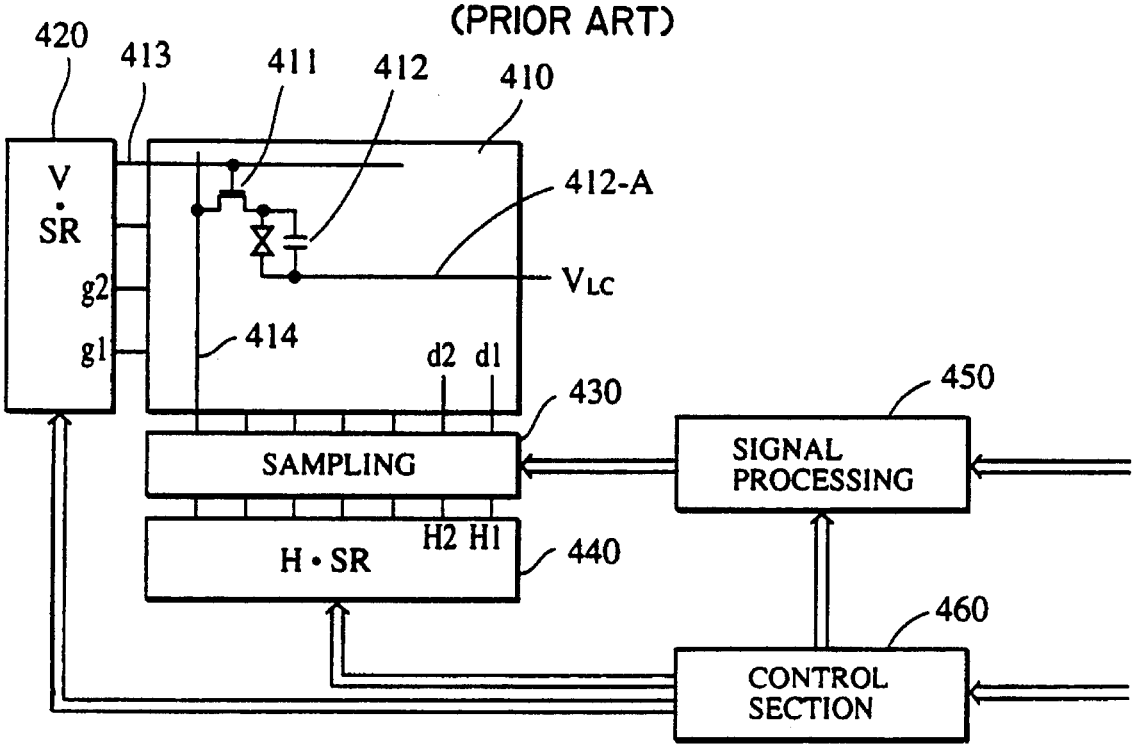
FIG. 4 (PRIOR ART)
FIG. 4 is a block diagram illustrating another color liquid-crystal display apparatus.
Figure 5:
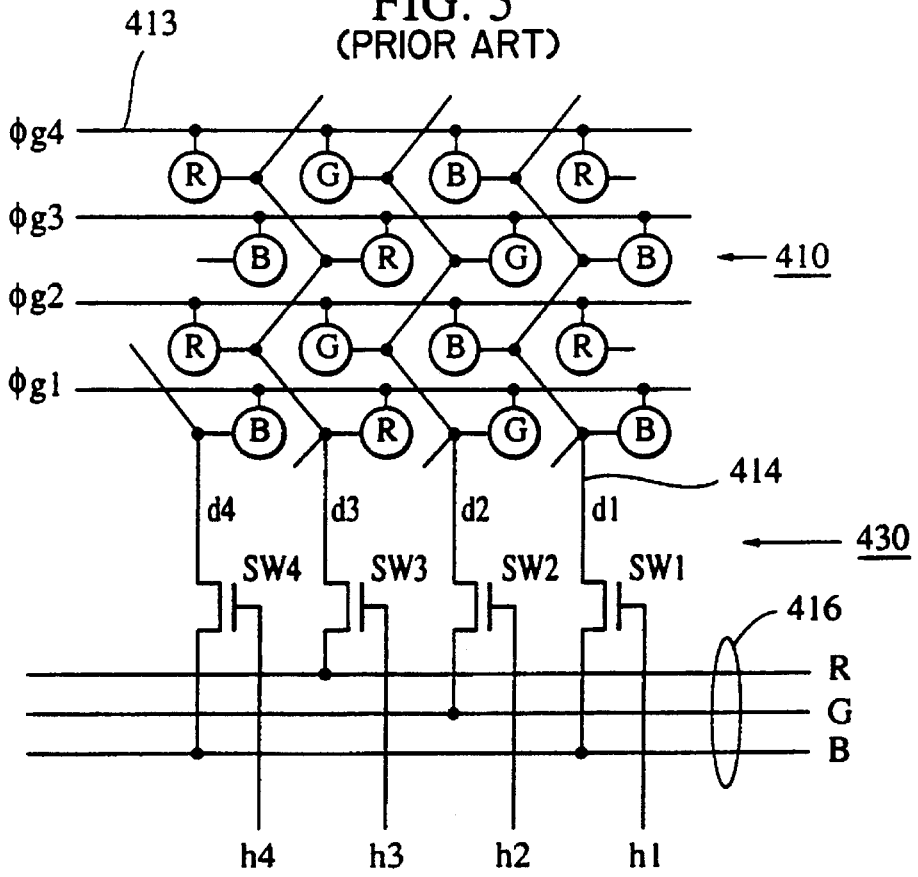
FIG. 5 (PRIOR ART)
FIG. 5 is an equivalent circuit diagram of a display element section 410 and a sampling circuit 430 in the apparatus of FIG. 4.
Figure 6:
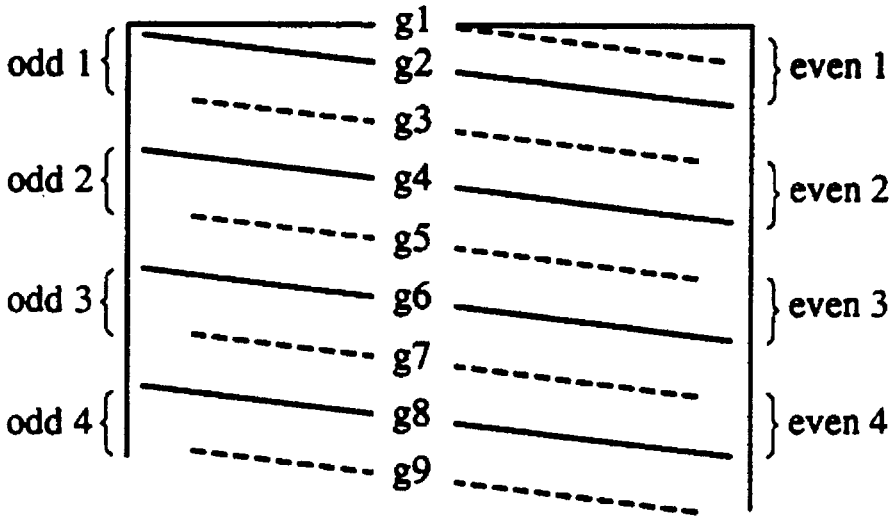
FIG. 6 (PRIOR ART)
FIG. 6 is an illustration of an interlace scanning in the liquid-crystal display apparatus.
Figure 20:
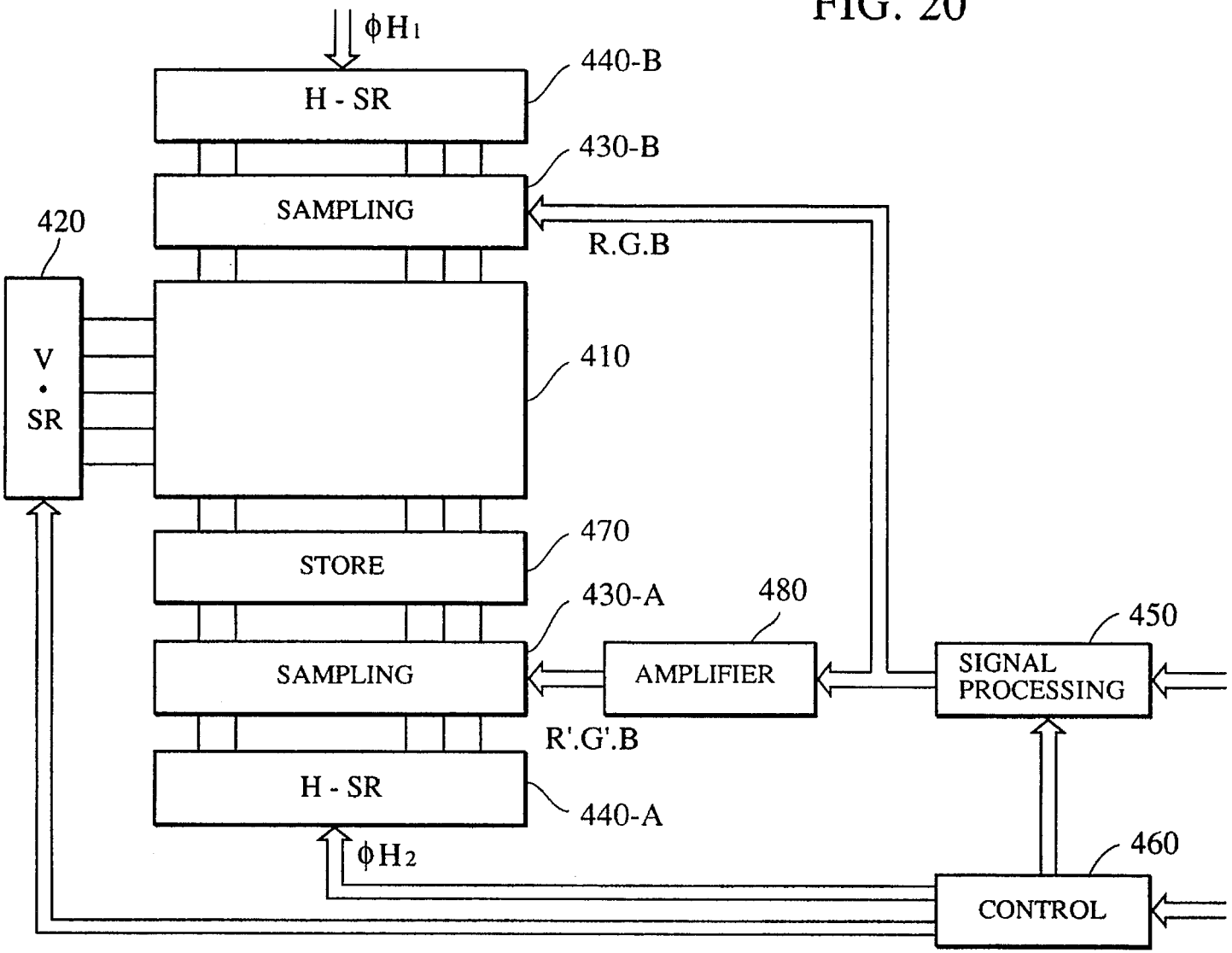
FIG. 20 is a schematic block diagram illustrating another embodiment of the present invention.

FIG. 20 is a schematic block diagram of this embodiment. The circuits having the same operation or function in FIG. 20 as those in FIG. 4 are given the same reference numerals. In this embodiment, two image input writing means are disposed for One vertical data line; the first writing means thereof are a sampling circuit 430-B and a horizontal scanning circuit 440-B, and the second writing means thereof are a scanning circuit 430-A, a horizontal scanning circuit 440-A, and a temporary storage circuit 470. In other words, in this embodiment, the temporary storage circuit 470, which is a memory circuit, is disposed in only the second writing means side.

The color signals branch to a system in which the signals are output directly to the sampling circuit 430-B from the temporary storage circuit 470 and to a system in which the signals are output to the scanning circuit 430-A via an amplifier 480.

Since the temporary storage circuit 470 is generally formed of a capacitance, if the signal is transferred from the storage circuit to the pixel capacitance via the vertical data line, the capacitance is divided mainly because of the parasitic capacitance of the vertical data lines, and the amplitude of the signal is decreased. The amplifier 480 is provided to compensate for this decrease in the signal amplitude.

Figure 21:
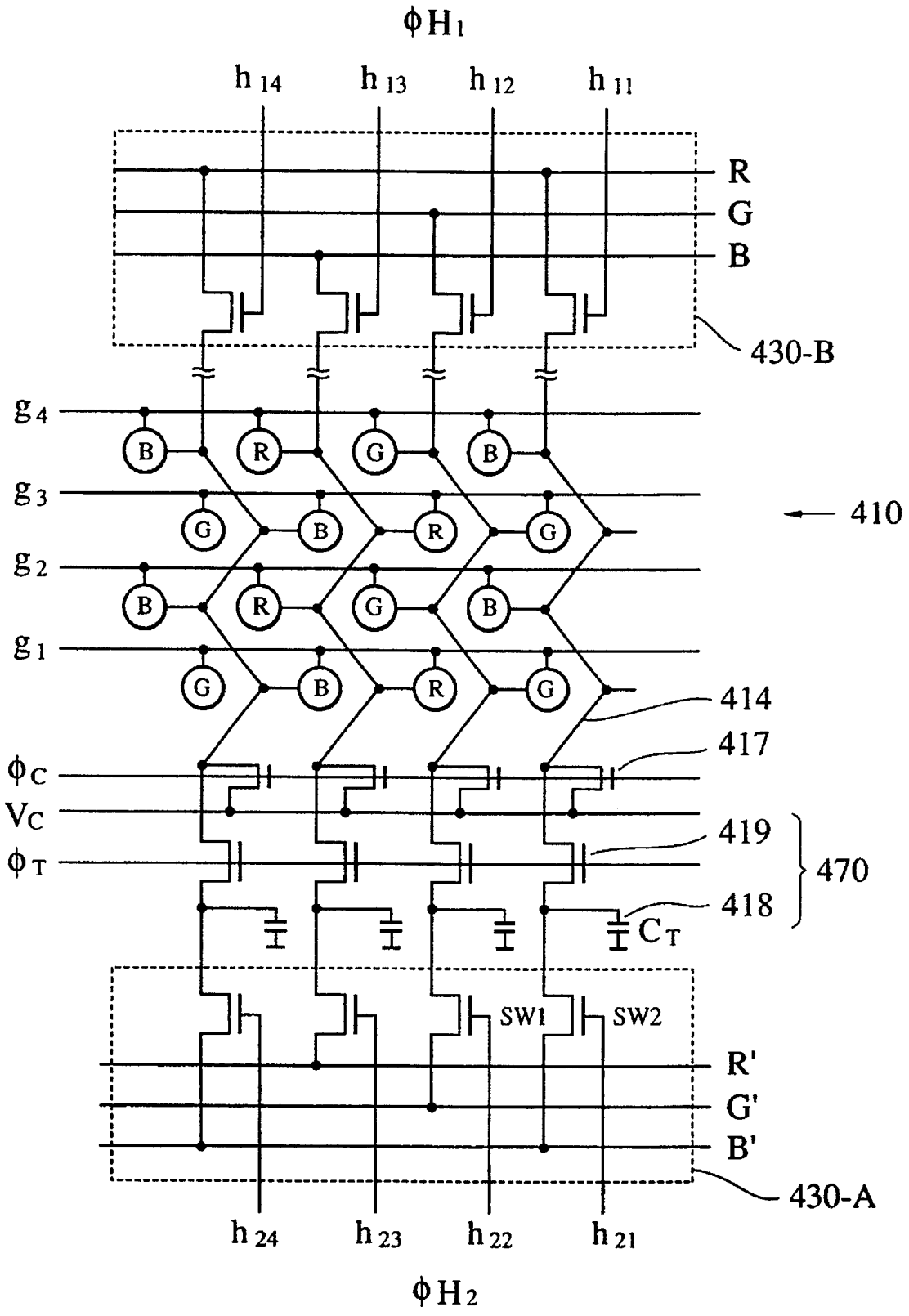
FIG. 21 is a schematic circuit diagram of the liquid-crystal display apparatus shown in FIG. 20.

FIG. 21 schematically shows an example of an equivalent circuit of this embodiment. As shown in FIG. 21, in one vertical data line 414, the pixels of the same color of the display element section 410 are arranged distributed alternately on the left and right for every other line. Also, each pixel is provided with an unillustrated switching element, making it possible to supply a display signal to each pixel electrode (not shown) by selecting the gate.

One of the main electrodes of a reset transistor 417 is connected to each vertical data line 414, and the other is connected to the reset electrical potential Vc. The control electrodes of a plurality of reset transistors 417 connected to each of the vertical data line 414 are electrically connected to each other, making it possible for the plurality of reset transistors 417 to be driven simultaneously.

The temporary storage circuit 470 has a temporary storage capacitance 418 ($C_T$) and a transfer transistor 419 for transferring signal charge stored in the temporary storage capacitance 418 to the vertical data line 414. In this embodiment, similarly to the reset transistor 417, the respective control electrodes of the plurality of transfer transistors 419 are electrically connected in common, making it possible for them to be driven simultaneously.

FIG. 22 (A) shows an example of a drive timing in accordance with this embodiment. In each of the pulses shown, each transistor conducts in a "high" period.

In the T1 period, by making pulse $\phi$c reach a high state, the reset transistor 417 is made to conduct, and the vertical data line 414 is reset to the electrical potential Vc. Next, when the horizontal scanning pulse $\phi$H1 (h11, h12 . . . ) and the vertical gate pulse $\phi$g2 are each made to reach a high state in the T2 period, the color signals (R, G and B) are written directly in the pixels (g2) of each line. Also, when the horizontal scanning pulse ϕH2 (h21, h22 . . . ) are each made to reach a high state, the color signals (R', G' and B') are stored in the temporary storage capacitance 418 of the temporary storage circuit 470. When the T2 period is terminated, the vertical gate pulse ϕg2 reaches a low state, causing the pixel transistors of the row pixels not to conduct, and thus the written voltage is maintained.

In the T3 period, the reset transistor 417 is made to conduct by making the pulse ϕc reach a high state, the remaining charge of the vertical data line 414 is removed, and the data line is reset to the reference electrical potential Vc. Then, in the T4 period, the transfer transistor 419 is made to conduct by making the pulse ϕc reach a high state, and the row pixel (g1) is made to conduct by making the pulse ϕg1 reach a high state, the color signals (R', G' and B') of the temporary storage capacitance 418 are transferred and then written. At this time, the signal level of the signals written in the row pixel (g1) is decreased due to the division of capacitance, the level becomes equal to the signal level written in the previous pixel line (g2) because the signal is amplified beforehand.

In this way, the color signals from the signal processing circuit 450 has been written and held in two row pixels at different timings by a series of driving during one horizontal scanning period from T1 to T4 periods. Therefore, the sampling frequency of the image signal becomes twice as high as in the prior art between two row pixels. Thus, the resolution is improved, and core moire caused by sampling looping distortion can be reduced.

Figures 22A, 22B:
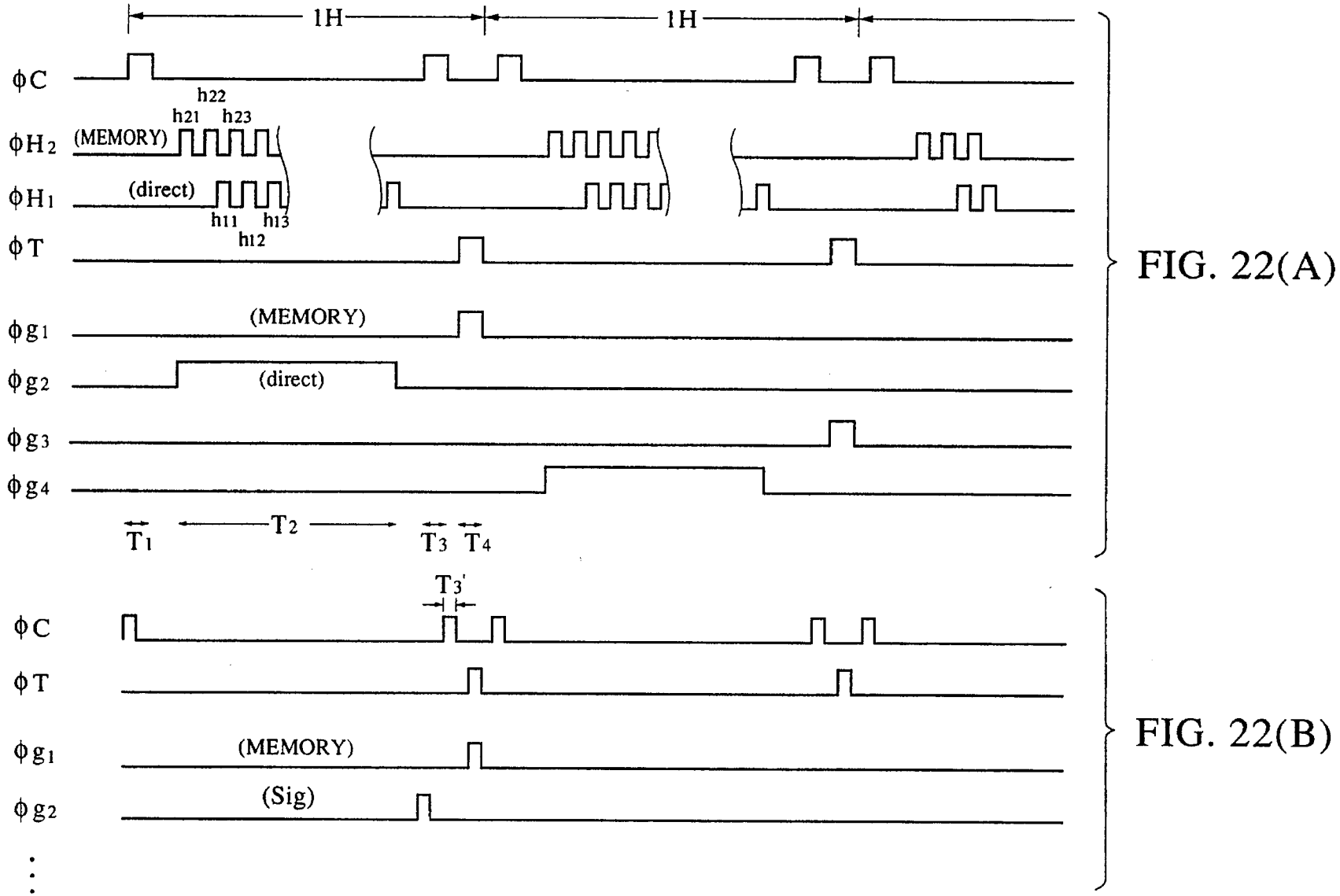
FIGS. 22(A) and 22(B) are timing charts illustrating the drive timing of the embodiment of the present invention.

The deviation of start timings between pulses ϕH1 and ϕH2 and h11 and h22 in FIG. 22(A) takes into consideration the deviation for 1.5 pixels in the spatial arrangement of the signals of the same color between two row pixels.

In FIG. 21, $g_i$ (i=1, 2 . . . ) may be a gate line of a three-terminal type switching element or facing scanning pole thereof. That is, the intersection 414 of $g_i$ (i=1, 2 . . . ) and the data line may be a thin film transistor (TFT) or a diode (including a metal-insulator-metal (MIM)).

[Tenth Embodiment]

A tenth embodiment will now be described. The tenth embodiment is the same as the ninth embodiment except the drive timing. The drive timing of the tenth embodiment is shown in FIG. 22(B). The sampling timings of ϕH2 and ϕH2 are the same as those in FIG. 22(A).

In this embodiment, image signals sampled by the sampling circuit 430-B in the T2 period are temporarily stored in the wiring capacitance of each of the vertical data lines, and the stored signals are transferred to a corresponding pixel in accordance with the pulse ϕg2 in the T3 period. Next, the data line is reset to the reference electrical potential Vc in the T3' period, and the signal of the temporary storage capacitance 418 is transferred to the corresponding pixel by turning the pulse ϕg1 and ϕT high in the T4 period.

If the voltage of the gate line is fluctuated when a signal is applied, depending upon the characteristics of the switching element, the pixels in a line other than the line at which the pixels are to be written may fluctuate and leak. However, according to this embodiment, there is no crosstalk or leak, and it is possible to obtain a stable image by merely providing a memory on one side.

[Eleventh Embodiment]

Figure 23:
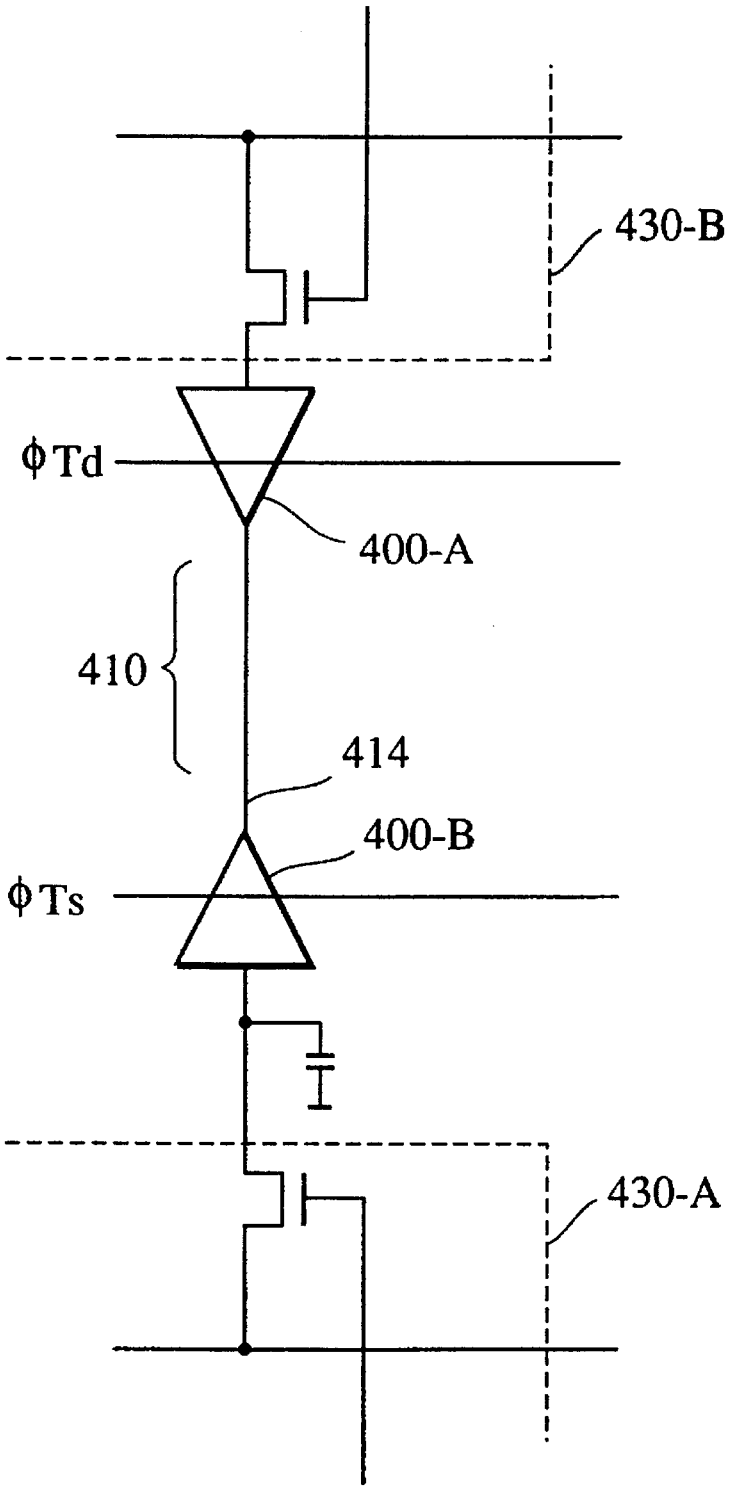
FIG. 23 is a schematic circuit diagram illustrating still another embodiment of the present invention.

FIG. 23 shows an eleventh embodiment of the present invention.

In this embodiment, by providing a buffer circuit 400-B in the stage anterior to the data line 414 on the storage circuit 470 side, it is possible to prevent the signal from decreasing due to the division of capacitance and to make the amplifier 480, described in the embodiment in FIG. 20, unnecessary. Also, by providing a buffer circuit 400-A in the stage anterior to the data line 414 on the sampling circuit 430 side, it is possible to cancel a fixed offset voltage between the buffer circuits 400-A and 400-B.

In FIG. 23, ϕTd and ϕTs each designate a power-supply control pulse. It is possible to decrease consumption of power by supplying power to the buffer circuit only when a signal charge is transferred to the pixel. The pixels of the display section 410 are not illustrated.

According to the present invention, as described above, a liquid-crystal display apparatus capable of displaying a higher-resolution and higher-quality image than before, and a method of driving the liquid-crystal display apparatus are provided. Also, according to the present invention, a liquid-crystal display apparatus capable of displaying a high resolution image in such a simple construction that two image input means are provided, and a method of driving the liquid-crystal display apparatus are provided. Also, an active matrix type liquid-crystal display apparatus, which consumes a small amount of power, has a small size and is inexpensive because no frame memory is used, and a method of driving the liquid-crystal display apparatus are provided.

In addition, according to the present invention, it is possible to easily switch colors and to easily drive a high-resolution color liquid-crystal display apparatus. Also, even if two colors are arranged in column electrode lines alternately, the colors do not become mixed, and a small amount of power is required since the horizontal scanning circuit can be operated at a normal drive frequency. Furthermore, according to the present invention, it is possible to display an image having a high horizontal and vertical resolution and being free from flicker.

In addition, according to the present invention, it is possible to reduce considerably the horizontal drive frequency to lengthen the sampling time. Therefore, it becomes possible to make a high-resolution display faithful to the image signal with reduced power consumption.

Although, not described in the above description, it is preferable that the polarity applied to the liquid crystal be inverted to a reverse polarity alternately (inversion driving). In this case, the signals distributed to the upper and lower portions may have polarities opposite to each other, or the polarity may be inverted for each field.

Although, in the above description, an example is explained in which three colors of R, G and B are used, other colors may be combined additionally as required. Needless to say, mono-color such as white and black, or a two color display may be used.

The present invention is not limited to a color pixel arrangement. The present invention is applicable by varying the timing of the sampling circuit appropriately in accordance with the color pixel arrangement.

In the present invention, the second horizontal scanning circuit, in addition to being disposed in a side opposite to the first horizontal scanning circuit, may be disposed in the same side.

Many different embodiments of the present invention may be constructed without departing from the spirit and scope of the present invention. It should be understood that the present invention is not limited to the specific embodiments described in this specification. On the contrary, the present invention is intended to cover various modifications and equivalent arrangements included within the spirit and scope of the claims. The following claims are to be accorded the broadest interpretation, so as to encompass all such modifications and equivalent structures and functions.

What is claimed is:

1. A liquid-crystal display apparatus, comprising:

a plurality of pixels, arranged in a matrix form having a plurality of pixel rows, each pixel having a switching element;

a plurality of data lines coupled to the pixel rows by the switching elements;

a vertical scanning circuit for selecting a row of said pixels;

first writing means, including a first horizontal scanning circuit for generating a first signal used to sample an image signal to be supplied to said pixels, connected to a side of the plurality of data lines;

a second horizontal scanning circuit for generating a second signal used to sample an image signal to be supplied to said pixels, connected to an opposite side of the plurality of data lines; and second writing means having storing means for storing image signals sampled by said second horizontal scanning circuit, wherein said first writing means consecutively supplies the image signals directly to the data lines without intermediate storage of the image signals in a $T_2$ period of every horizontal scanning period (1H period), and said second writing means consecutively supplies the image signals to said storing means in said $T_2$ period so that the image signals are stored by said storing means and then supplied to the data lines when said $T_2$ period is terminated.

2. A liquid-crystal display apparatus according to claim 1, wherein said first and second writing means supply signals to different rows of pixels.

3. A liquid-crystal display apparatus according to claim 1, wherein said plurality of pixels have filters of colors selected from among at least three different colors.

4. A liquid-crystal display apparatus according to claim 1, wherein the image signals are signals based on image data of red (R), green (G), and blue (B), respectively.

5. A liquid crystal display apparatus according to claim 1, further comprising reset means for resetting the potential of said plurality of data lines to a reference potential.

6. A liquid crystal display apparatus according to claim 5, wherein said reset means comprises a plurality of transistors each having first and second main electrodes and a control electrode, the first main electrode of each transistor being connected to a respective one of said plurality of data lines, and the second main electrode of each transistor being connected to the reference potential, and a control line for connecting the respective control electrodes of the transistors.

7. A method of driving a liquid-crystal display apparatus comprising a plurality of pixels, arranged in a matrix form, each of which having a switching element, the pixels being arranged in a plurality of rows, a plurality of data lines coupled to the pixel rows by the switching elements, a first horizontal scanning circuit connected to a side of the plurality of data lines, for generating a first signal used to sample an image signal to be supplied to the pixels, a second horizontal scanning circuit, connected to an opposite side of the plurality of data lines, for generating a second signal used to sample an image signal to be supplied to the pixels, storing means, for storing image signals sampled by the second horizontal scanning circuit, and a vertical scanning circuit for selecting a row of the pixels, said method comprising the steps of:

(a) directly writing the image signals sampled by the first horizontal scanning circuit to a first row of the plurality of rows of the pixels without intermediate storage;

(b) storing, in the storing means, the image signals sampled by the second horizontal scanning circuit; and (c) writing the stored image signal to a row of the pixels adjacent to the first row.

8. A method of driving a liquid crystal display apparatus according to claim 7, wherein during the period between said direct writing of the image signals and the writing of the stored image signals, the potential of the plurality of data lines is reset to a reference potential.

* * * * *

UNITED STATES PATENT AND TRADEMARK OFFICE

CERTIFICATE OF CORRECTION

PATENT NO. : 5,619,225

DATED : April 8, 1997

INVENTOR(S) : SEIJI HASHIMOTO

It is certified that error appears in the above-indentified patent and that said Letters Patent is hereby corrected as shown below:

COLUMN 3

Line 49, "even" should read --even 1--.

COLUMN 4

Line 50, "column a" should read --a column--.
Line 54, "double" should read --doubled--.

COLUMN 6

Line 12, "lines;" should read --lines; and--.

COLUMN 7

Figure 7:
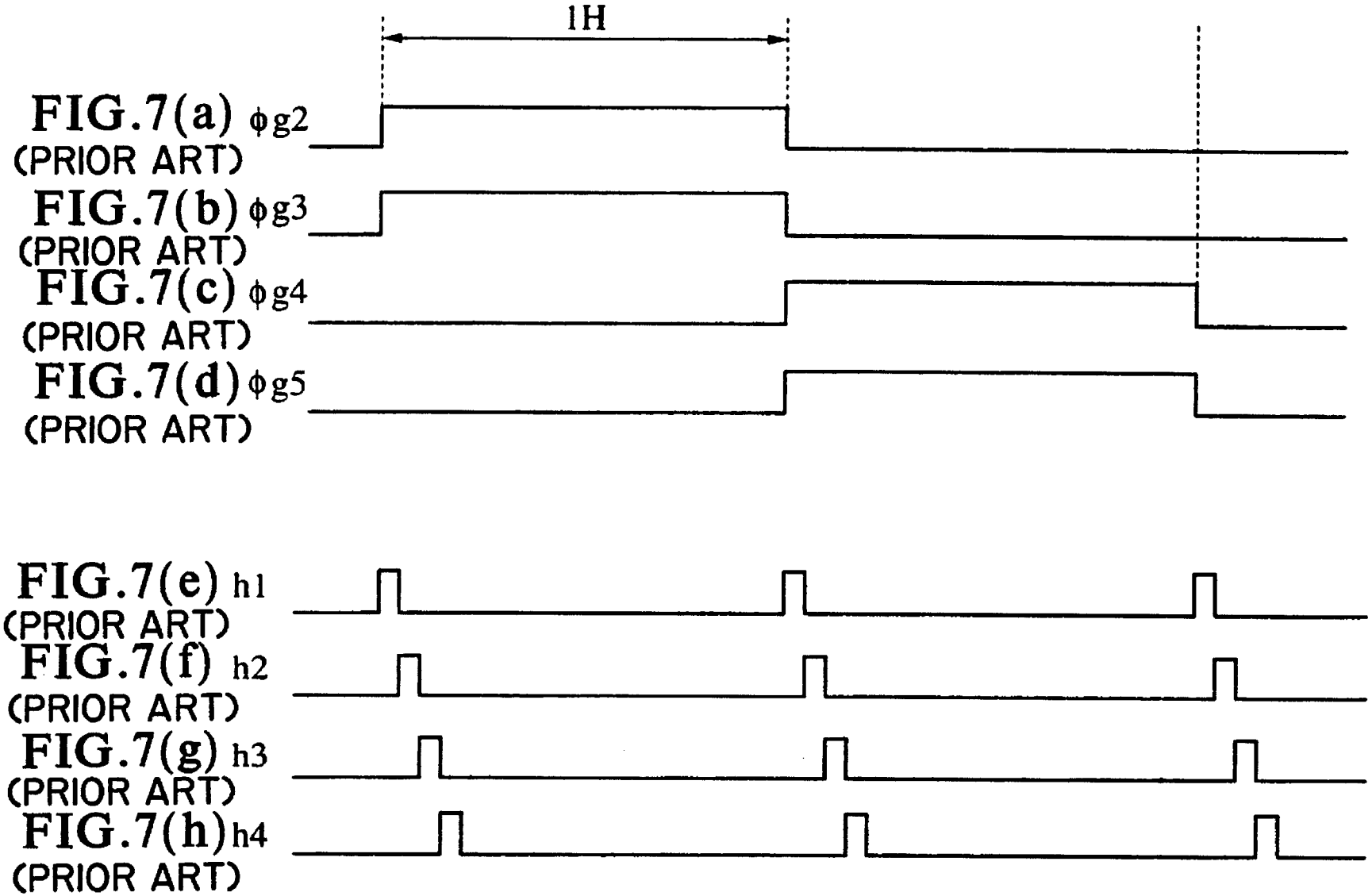
FIG. 7 is a timing chart illustrating an example of drive timing when the scanning example of FIG. 6 is applied to that of FIG. 5.
Figure 8:
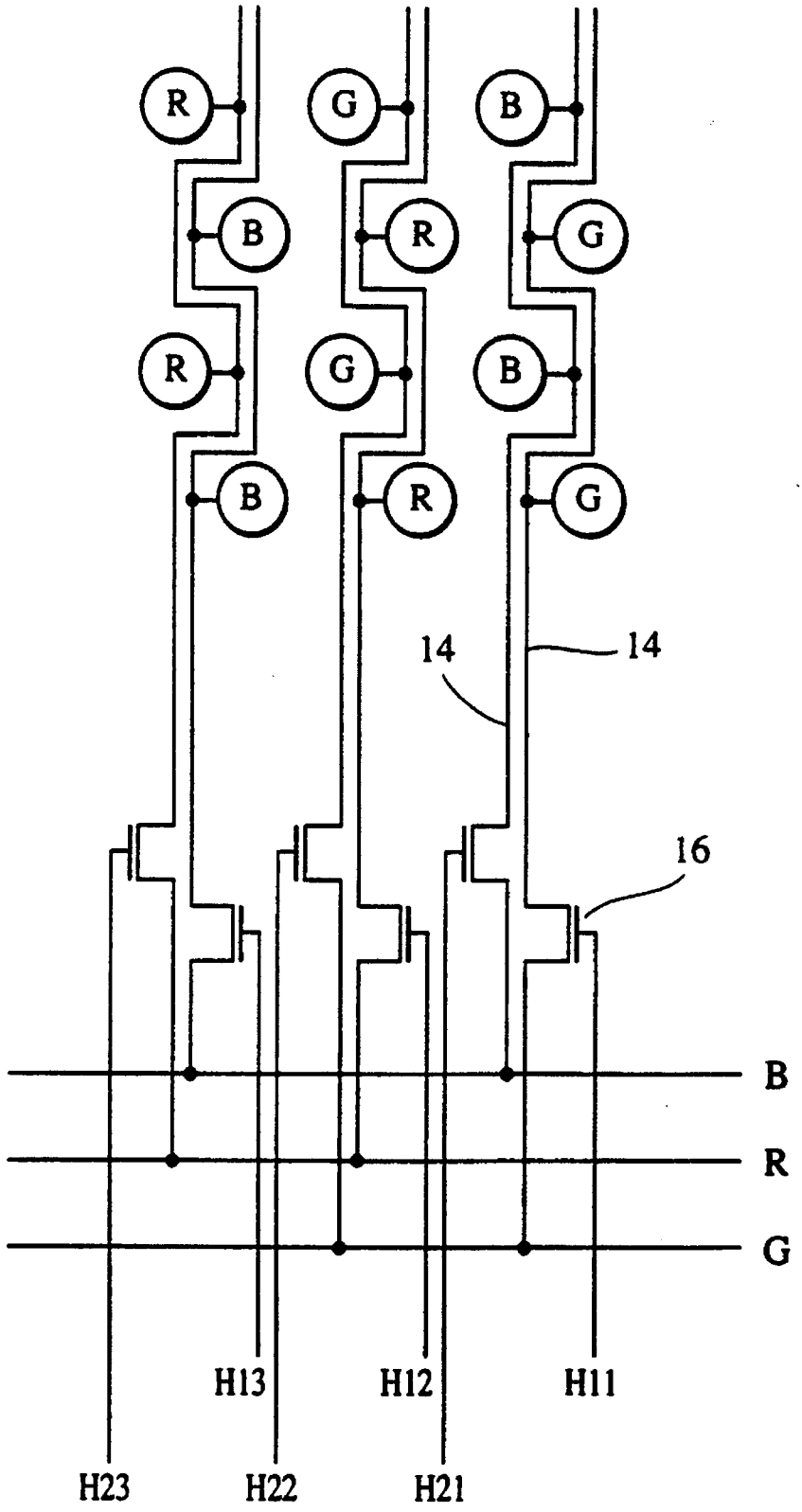
FIG. 8 (PRIOR ART)
FIG. 8 is an illustration of an example of wiring of another liquid-crystal display apparatus.
Figure 9:
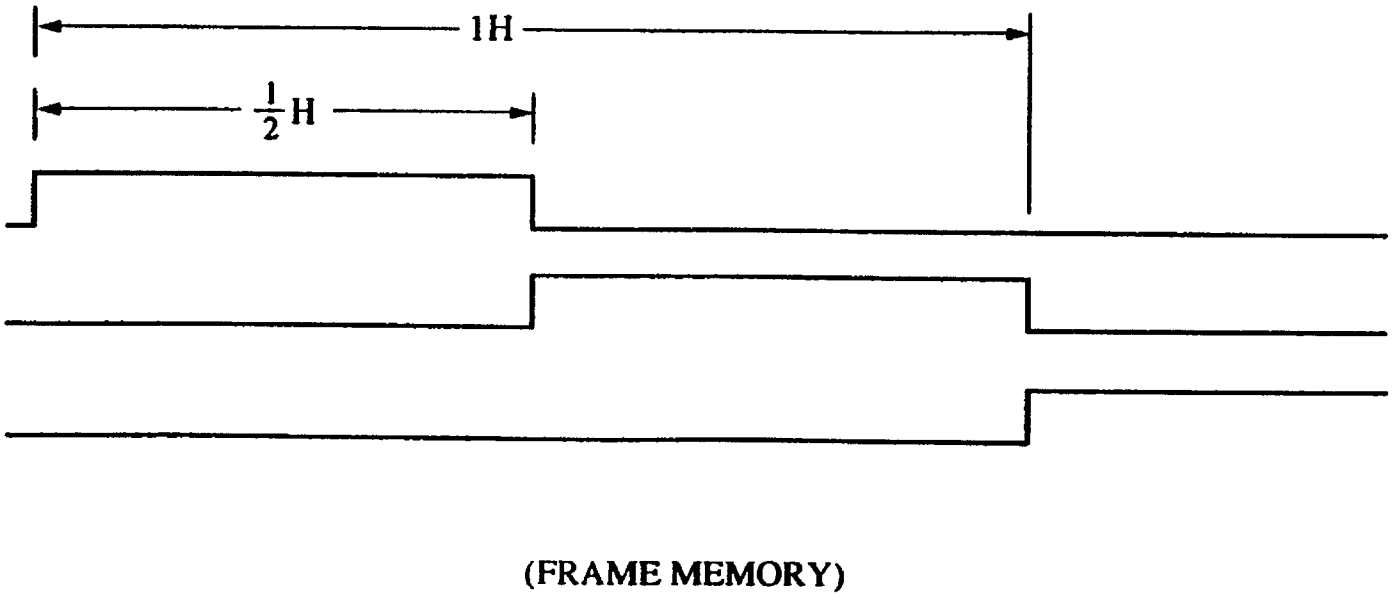
FIG. 9 is a timing chart illustrating an example of drive timing of a double-speed scanning.

Line 16, "FIG. 7" should read --FIG. 7, consisting of FIGS. 7(a)-7(h),--.
Line 21, "FIG. 9" should read --FIG. 9, consisting of FIGS. 9(a)-9(c),--.
Line 28, "FIG. 12" should read --FIG. 12, consisting of FIGS. 12(a)-12(i),--.
Line 36, "FIG. 15" should read --FIG. 15, consisting of FIGS. 15(a)-15(i),--.

COLUMN 8

Line 7, "denote each" should read --each denote--.

UNITED STATES PATENT AND TRADEMARK OFFICE

CERTIFICATE OF CORRECTION

PATENT NO. : 5,619,225

DATED : April 8, 1997

INVENTOR(S) : SEIJI HASHIMOTO

It is certified that error appears in the above-indentified patent and that said Letters Patent is hereby corrected as shown below:

COLUMN 10

Line 10, "C22, C22 and" should read --C22, C23 and--.
Line 11, "C23" should read --C24--.
Line 16, "pulses $H_{1n}$" should read --pulses H1n--.
Line 33, "pulse reset" should read --reset pulse--.
Line 59, "signals" should read --Signals--.

COLUMN 11

Line 38, "another" should read --other--.

COLUMN 12

Line 15, "One" should read --one--.
Line 48, "line 414" should read --lines 414--.

COLUMN 14

Line 41, "Although," should read --Although--.

UNITED STATES PATENT AND TRADEMARK OFFICE

CERTIFICATE OF CORRECTION

PATENT NO. : 5,619,225

DATED : April 8, 1997

INVENTOR(S) : SEIJI HASHIMOTO

It is certified that error appears in the above-indentified patent and that said Letters Patent is hereby corrected as shown below:

COLUMN 16

Line 1, "liquid crystal" should read --liquid-crystal--.
Line 4, "liquid crystal" should read --liquid-crystal--.
Line 35, "liquid crystal" should read --liquid-crystal--.

Signed and Sealed this

Twenty-first Day of October 1997

*Attest:*

*Attesting Officer*

BRUCE LEHMAN

*Commissioner of Patents and Trademarks*